US011279575B2

(12) United States Patent
Hayasaka et al.

(10) Patent No.: US 11,279,575 B2
(45) Date of Patent: Mar. 22, 2022

(54) SHEET FEEDING DEVICE, IMAGE FORMING APPARATUS INCORPORATING THE SHEET FEEDING DEVICE, AND IMAGE FORMING SYSTEM INCORPORATING THE SHEET FEEDING DEVICE

(71) Applicants: Kenji Hayasaka, Kanagawa (JP); Takashi Fukumoto, Kanagawa (JP)

(72) Inventors: Kenji Hayasaka, Kanagawa (JP); Takashi Fukumoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 167 days.

(21) Appl. No.: 16/583,498

(22) Filed: Sep. 26, 2019

(65) Prior Publication Data

US 2020/0102166 A1 Apr. 2, 2020

(30) Foreign Application Priority Data

Sep. 28, 2018 (JP) ..... JP2018-185730

(51) Int. Cl.
*B65H 1/08* (2006.01)

(52) U.S. Cl.
CPC ..... *B65H 1/08* (2013.01); *B65H 2405/1116* (2013.01); *B65H 2405/1122* (2013.01); *B65H 2701/1125* (2013.01)

(58) Field of Classification Search
CPC ... B65H 1/00; B65H 1/04; B65H 1/08; B65H 1/14; B65H 1/26; B65H 3/047; B65H 3/128; B65H 2405/1111; B65H 2405/1116; B65H 2405/11162; B65H 2405/1122; B65H 2405/112; B65H 2701/1113; B65H 2701/1125; B65H 2511/16
See application file for complete search history.

(56) References Cited

U.S. PATENT DOCUMENTS

2013/0214483 A1* 8/2013 Hirahara ..... B65H 3/56 271/264
2013/0242359 A1 9/2013 Heishi et al.
2013/0320611 A1 12/2013 Kubo et al.
(Continued)

FOREIGN PATENT DOCUMENTS

JP 8-169632 7/1996
JP H09-040192 A 2/1997
JP 2016-088682 5/2016

OTHER PUBLICATIONS

Japanese Office Action dated Feb. 21, 2020.

*Primary Examiner* — Prasad V Gokhale
(74) *Attorney, Agent, or Firm* — Harness, Dickey & Pierce, P.L.C.

(57) ABSTRACT

A sheet feeding device includes a sheet loader, a sheet feeder, and an end fence. The sheet loader is configured to load a sheet bundle including sheets. The sheet feeder is configured to feed an uppermost sheet of the sheet bundle loaded on the sheet loader. The end fence is disposed movable in a sheet feeding direction of the uppermost sheet and is configured to contact a trailing end of the sheet bundle in the sheet feeding direction to regulate a position of the trailing end of the sheet bundle. The end fence includes an elastic body configured to contact the trailing end of the sheet bundle at a portion other than at least an upper portion of the end fence.

20 Claims, 16 Drawing Sheets

(56) References Cited

U.S. PATENT DOCUMENTS

| | | | | |
|---|---|---|---|---|
| 2015/0048566 | A1 | 2/2015 | Utagawa et al. | |
| 2016/0122144 | A1* | 5/2016 | Fukumoto | B65H 3/48 271/12 |
| 2016/0272443 | A1 | 9/2016 | Seto et al. | |
| 2018/0029811 | A1* | 2/2018 | Kimura | B65H 1/266 |
| 2019/0161302 | A1* | 5/2019 | Techlin | B65H 19/2269 |

* cited by examiner

SHEET FEEDING DEVICE, IMAGE FORMING APPARATUS INCORPORATING THE SHEET FEEDING DEVICE, AND IMAGE FORMING SYSTEM INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application No. 2018-185730, filed on Sep. 28, 2018, in the Japan Patent Office, the entire disclosure of which is hereby incorporated by reference herein.

BACKGROUND

Technical Field

This disclosure relates to a sheet feeding device, an image forming apparatus incorporating the sheet feeding device, and an image forming system incorporating the sheet feeding device.

Discussion of the Background Art

Various types of sheet feeding devices are known to include a loading unit on which a bundle of sheets (a sheet bundle) is loaded, a conveyance unit that conveys the uppermost sheet in the sheet bundle loaded on the loading unit, and an end fence that is movable in a sheet conveying direction of the sheets, is contacted or abutted on a trailing end of the sheet conveying direction of the sheet bundle, and regulates a position of the trailing end of the sheet bundle of sheets.

SUMMARY

At least one aspect of this disclosure provides a sheet feeding device including a sheet loader, a sheet feeder, and an end fence. The sheet loader is configured to load a sheet bundle including sheets. The sheet feeder is configured to feed an uppermost sheet of the sheet bundle loaded on the sheet loader. The end fence is disposed movable in a sheet feeding direction of the uppermost sheet and is configured to contact a trailing end of the sheet bundle in the sheet feeding direction to regulate a position of the trailing end of the sheet bundle. The end fence includes an elastic body configured to contact the trailing end of the sheet bundle at a portion other than at least an upper portion of the end fence.

Further, at least one aspect of this disclosure provides an image forming apparatus including an image forming device configured to form an image on a sheet, and the above-described sheet feeding device configured to feed the sheet toward the image forming device.

Further, at least one aspect of this disclosure provides an image forming system including an image forming apparatus configured to form an image at least on a sheet and the above-described sheet feeding device configured to feed the sheet toward the image forming apparatus.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
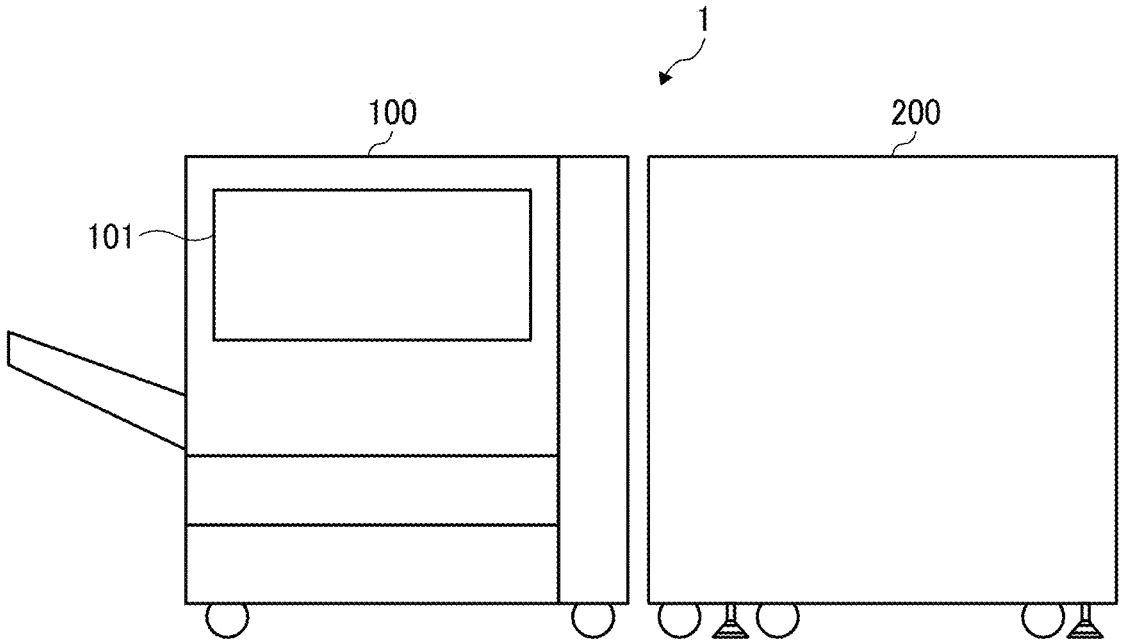
FIG. 1 is a diagram illustrating a schematic configuration of an image forming system according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to"

another element or layer, then it can be directly on, against, connected or coupled to the other element or layer, or intervening elements or layers may be present. In contrast; if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet feeding device, an image forming apparatus, and an image forming system according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet feeding device, image forming apparatus, and image forming system, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given of a sheet feeding device according to an embodiment of this disclosure.

FIG. 1 is a diagram illustrating a schematic configuration of an image forming system 1 according to an embodiment of this disclosure.

As illustrated in FIG. 1, the image forming system 1 includes an image forming apparatus 100 that includes an image forming device 101 to form an image on a sheet, and a sheet feeding device 200 to feed the sheet to the image forming apparatus 100. The sheet feeding device 200 is disposed at a side face of an apparatus body of the image forming apparatus 100.

The recording method of the image forming apparatus 100 to which the sheet feeding device 200 according to the present embodiment is applied is not particularly limited, and any method such as an electrophotographic method or an inkjet method is adopted. A sheet entrance is provided on the right side of the apparatus body of the image forming apparatus 100 in FIG. 1. A sheet conveyed from the sheet feeding device 200 comes into the apparatus body of the image forming apparatus 100 through the sheet entrance. At the sheet entrance, an opening and a sheet conveying unit are provided. The sheet is received through the opening and then is conveyed by the sheet conveyor.

Figure 2:
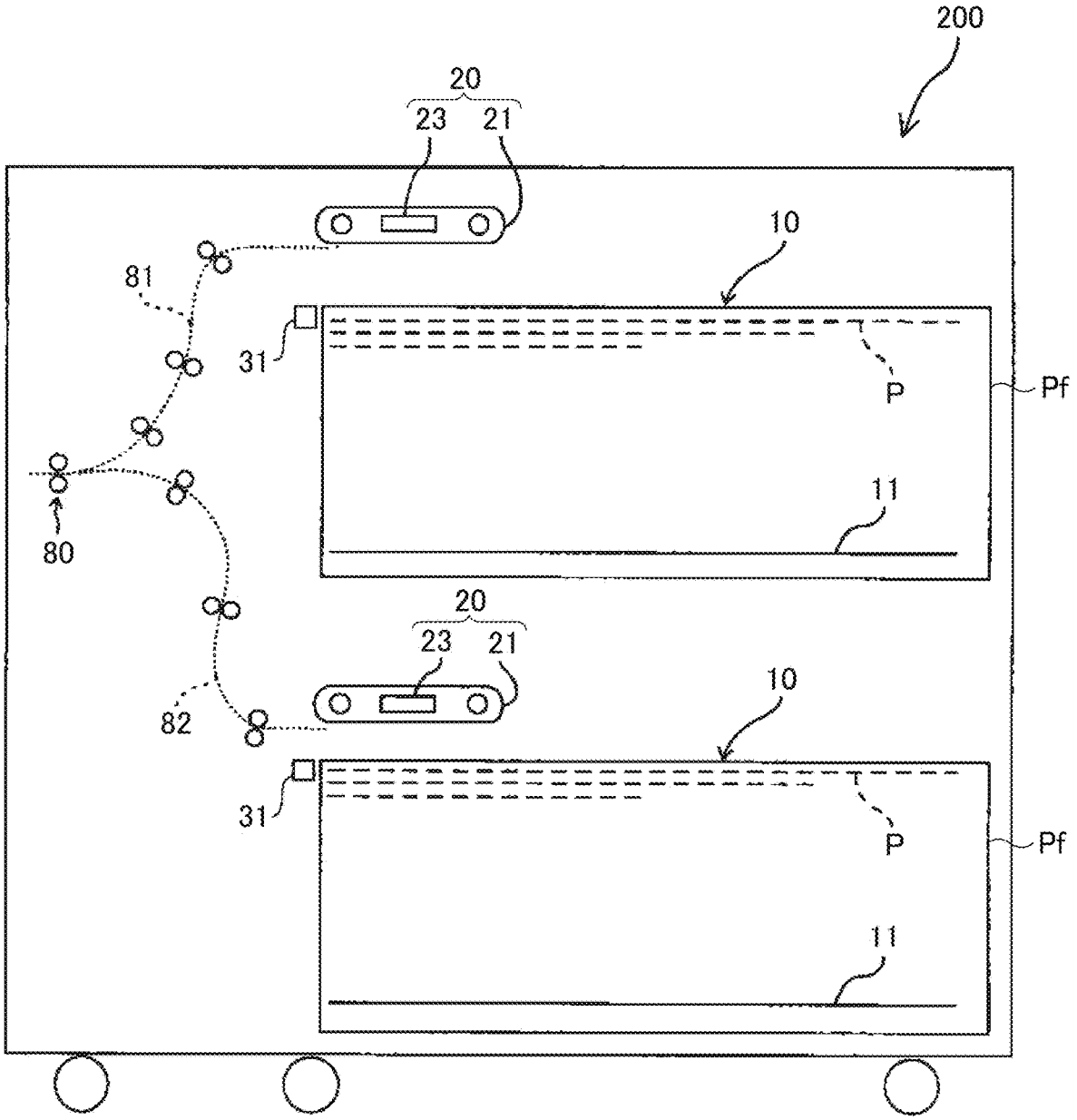
FIG. 2 is a schematic diagram illustrating a sheet feeding device according to an embodiment of this disclosure.

FIG. 2 is a diagram illustrating a schematic configuration of the sheet feeding device 200 according to the present embodiment this disclosure. The sheet feeding device 200 is disposed n a side face of the apparatus body of the image forming apparatus 100.

As illustrated in FIG. 2, the sheet feeding device 200 includes two sheet trays 10 disposed vertically to each other (i.e., a lower sheet tray 10 and an upper sheet tray 10). Each of the sheet trays 10 that functions as a sheet loader includes a sheet loading table 11 that functions as an elevation body on which a sheet bundle Pf is loaded. In the present embodiment, each of the sheet trays 10 is capable of containing up to about 2500 sheets.

It is to be noted that the term "sheet" includes plain paper, coated paper, label paper, OHP sheet and film, and prepreg. Prepregs are mainly used as materials for laminates and multilayer printed wiring boards. For example, the prepreg includes a sheet-like material that is manufactured by, for example, continuously impregnating a resin varnish mainly formed by a thermosetting resin such as epoxy resin and polyimide resin, into an elongated base such as glass cloth, paper, non-woven cloth, and aramid cloth, then heating, drying, and cutting. Furthermore, the "sheet" includes bag-shaped material such as an envelope and a packaging material. It is also to be noted that the term "conveyance target object" corresponds to the sheet described above.

A sheet feeding unit 20 is disposed above each of the sheet trays 10. The sheet feeding unit 20 that functions as a sheet feeder attracts and feeds an uppermost sheet placed on top of the sheet bundle Pf loaded on the sheet tray 10. The sheet feeding unit 20 includes an attraction belt 21 that functions as a conveying body and a suction device 23.

Each sheet loaded on the lower sheet tray 10 passes through a lower conveyance passage 82 to be conveyed by a pair of ejection rollers 80 to the apparatus body of the image forming apparatus 100. Each sheet loaded on the upper sheet tray 10 passes through an upper conveyance passage 81 to be conveyed by the pair of ejection rollers 80 to the apparatus body of the image forming apparatus 100.

Figure 3:
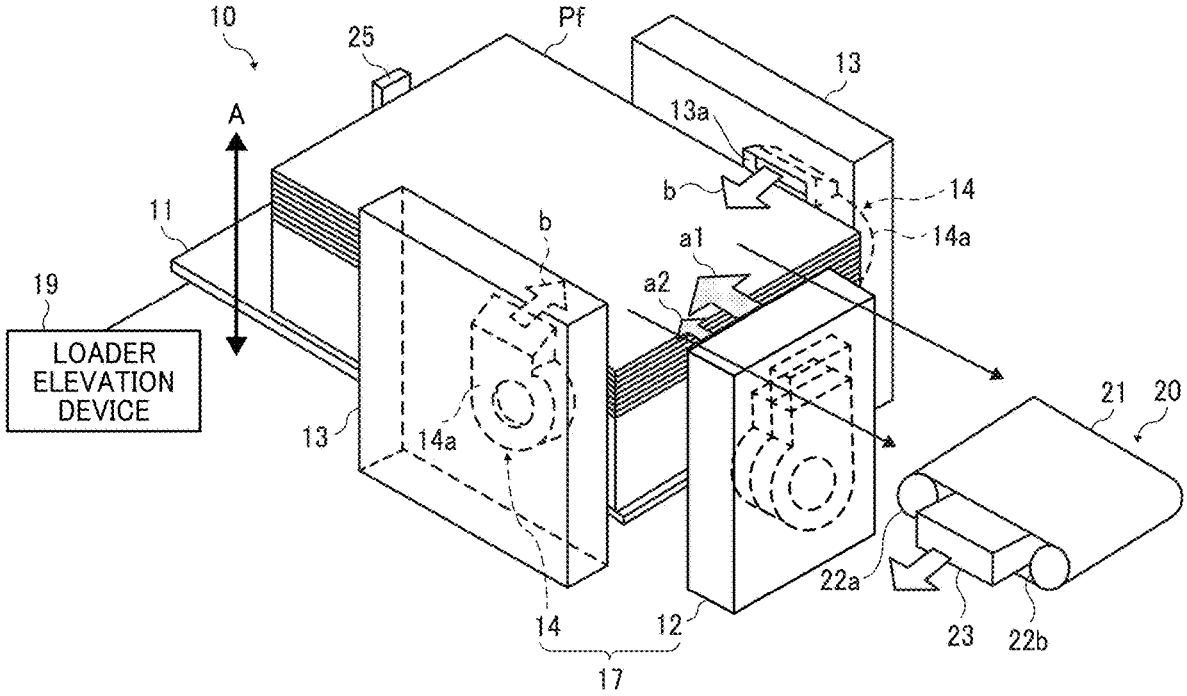
FIG. 3 is a perspective view illustrating a sheet tray and an area near the sheet tray.

FIG. 3 is a perspective view illustrating one of the sheet trays 10 and an area near the sheet tray 10. It is to be noted that, for understanding the present embodiment easier, the sheet feeding unit 20 in FIG. 3 is illustrated after being shifted in a direction indicated by arrow in FIG. 3, from the original arrangement position.

The attraction belt 21 of the sheet feeding unit 20 is stretched by two tension rollers 22*a* and 22*b* and includes multiple air drawing openings over an entire region in a circumferential direction. The multiple air drawing openings penetrate through the attraction belt 21 from the front face side to the back face side. The suction device 23 is disposed inside an inner loop of the attraction belt 21. The suction device 23 is coupled with a suction fan that intakes air via an air duct that functions as an air flowing passage. As the suction device 23 generates a negative pressure in a lower area, the sheet P is attracted to a lower face of the attraction belt 21.

Further, each sheet tray 10 includes an air blowing device 17 that functions as an air blower to blow air toward the sheets P on the upper portion of the sheet bundle Pf. The air blowing device 17 includes a front air blowing device 12 and side air blowing devices 14.

The side air blowing devices 14 are mounted in pairs on one side of each of a pair of side fences 13. Each of the side air blowing devices 14 blows air in a direction indicated by arrow "b" toward the side face of the upper portion of the sheet bundle Pf. Each of the side air blowing devices 14 includes a side floating nozzle and a side blower 14*a*. The side floating nozzle flips and separates the sheets P of the upper portion of the sheet bundle Pf and guides air to a direction to lift and float the sheets P. The side blower 14*a* sends air to the side floating nozzle. The air blown from the side floating nozzle in the direction indicated by, arrow b in the figure is called "side air". The side air is blown from a side nozzle 13*a* that is provided at a portion of each fence of the pair of side fences 13, facing the upper portion of the sheet bundle K. The air blown from the front air blowing device 12 and the discharge ports of the pair of side fences 13 causes the upper sheets of the sheet bundle Pf to float.

Further, the sheet tray 10 is provided with an end fence 25 for aligning the trailing ends of the sheets P of the sheet bundle Pf loaded on the sheet loading table 11. The sheet loading table 11 is movable in a direction indicated by arrow A, by a loader elevation device 19 that functions as a loader elevator.

Figure 4:
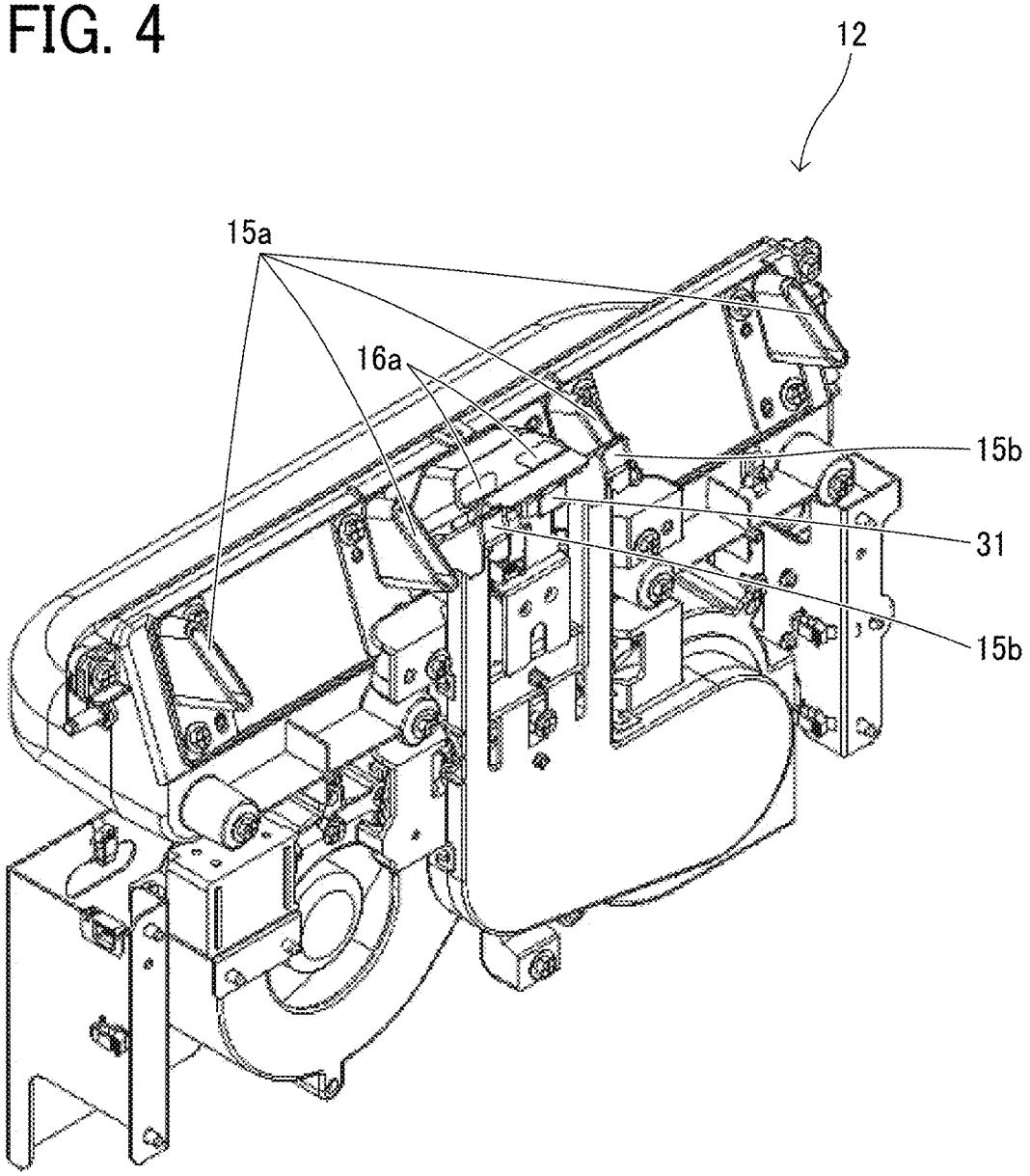
FIG. 4 is a perspective view illustrating a front blowing device.
Figure 5:
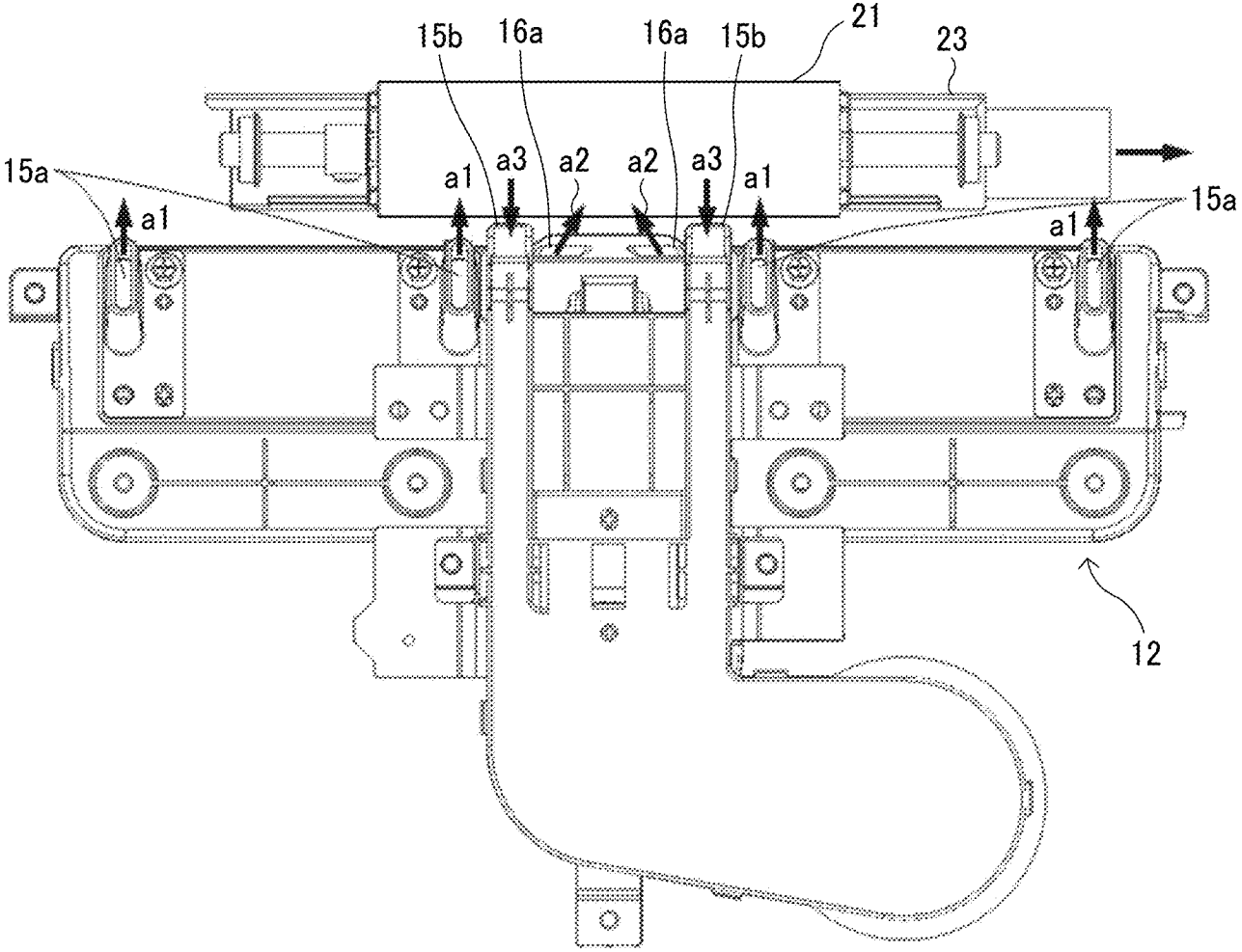
FIG. 5 is a front view illustrating the front blowing device.

FIG. 4 is a perspective view illustrating the front air blowing device 12. FIG. 5 is a front view illustrating the front air blowing device 12.

The front air blowing device 12 blows air to a leading end of the upper part of the sheet bundle Pf (i.e., a downstream side end in the sheet conveying direction). The front air blowing device 12 includes floating nozzles 15*a*, separation nozzles 16*a*, and downward suction nozzles 15*b*. The floating nozzles 15*a* guide air in a direction to float the sheets P on the upper portion of the sheet bundle Pf. The separation nozzles 16*a* guide air in a direction to separate an uppermost floating sheet P and other floating sheet(s) P. The downward suction nozzles 15*b* suck air near the leading end of the upper portion of the sheet bundle Pf.

Among these nozzles, air blown from the floating nozzles 15*a* is referred to as floating air, and air blown from the separation nozzles 16*a* is referred to as separation air. Air sucked from the downward suction nozzles 15*b* is referred to as downward suction air.

The floating air is blown out from portions facing the leading end of the upper portion of the sheet bundle Pf (i.e., the downstream side end in the sheet conveying direction) in a direction indicated by an arrow a1 in FIGS. 3 and 5, to the leading end of the upper portion of the sheet bundle Pf (i.e., the downstream side end in the sheet conveying direction). The separation air is blown out from portions facing the leading end of the upper portion of the sheet bundle Pf (i.e., the downstream side end in the sheet conveying direction) in a direction of the arrow a2 in FIGS. 3 and 5, to a portion between the uppermost sheet attracted to the attraction belt 21 and a second sheet P that is being floated.

The downstream suction air flows in a direction indicated by arrow a3 in FIG. 5 to be sucked by the downward suction nozzle 15*b*, thereby generating a negative pressure in the vicinity of the leading end of the upper portion of the sheet bundle Pf. As a result, force moving in a direction away from the attraction belt 21 is generated, and the floating second or subsequent sheet is quickly dropped into the sheet bundle Pf.

Next, a description is given of sheet feeding operations of the sheet feeding device 200.

When a command to start sheet feeding is received from a host controller of the apparatus body of the image forming apparatus 100, the loader elevation device 19 is driven to elevate the sheet loading table 11. When a sheet detection sensor 31 detects the upper surface of the sheet bundle Pf, the loader elevation device 19 is stopped driving. Then, while the attraction belt 21 is being stopped, the air blowing device 17 starts blowing to start a blowing control. The suction device 23 starts sucking air to start a suction control. When the air blowing device 17 starts blowing air, the floating air, the separation air, and the side air are blown from the floating nozzle 15*a*, the separation nozzle 16*a*, and the side nozzle 13*a* to the front end in the upper portion of the sheet bundle Pf.

The leading ends of the plurality of sheets P in the upper portion of the sheet bundle Pf float by blowing the floating air and the side air, a negative pressure is generated below the attraction belt 21 by sucking the suction device 23, and an uppermost sheet P that is floating is attracted to the attraction belt 21. When the uppermost sheet P is attracted to the attraction belt 21, the separation air is blown from the separation nozzle 16*a* between the uppermost sheet P and the second sheet P, and the uppermost sheet P attracted to the attraction belt 21 and the second or subsequent sheet P is separated.

Next, the attraction belt 21 is rotated to feed the uppermost sheet P. At this time, if the second or subsequent sheet P excessively floats or disturbs the behavior and contact the uppermost sheet P, the second or subsequent sheet P is likely to be conveyed together with the uppermost sheet P. Therefore, in the present embodiment, when the uppermost sheet P is started to feed the uppermost sheet P (when the attraction belt 21 is rotated), blowing of the front floating air and the separation air is stopped, and the suction of air is started from the downward suction nozzle 15*b*. As a result, the floating second or subsequent sheet P is quickly dropped to prevent contact with the uppermost sheet P, thereby preventing multifeeding.

When a given time has elapsed from the start of feeding (when the leading end of the uppermost sheet P is fed to a portion of a given post process (for example, a pair of sheet conveying rollers) downstream from the attraction belt 21 in the sheet conveying direction), the suction device 23 is stopped sucking, and the first sheet attracted to the attraction belt 21 is separated. Furthermore, the driving of the feeding motor is stopped to stop the rotation of the attraction belt 21.

In a case in which there is a subsequent sheet to be fed, the blowing of the front floating air and the separation air is started again, air suction from the downward suction nozzle 15*b* is stopped, and the floating of the subsequent sheet to be fed is prevented from being hindered due to the downward suction air. Then, sheet attraction to the attraction belt 21 by the suction device 23 is started again. Thereafter, the sheet feeding processing similar to the above-described sheet feeding processing is performed.

Next, a description is given of details of the present embodiment.

In a case in which an image on a sheet having a large thickness deviation in the sheet conveying direction, such as a bag member having a zipper at the opening, as the sheet to be fed, the thin side is generally set as the leading end of the sheet Pin the sheet tray 10, considering the conveyance capability. If the thicker side of the sheet P is set in the leading end of the sheet P in the sheet conveying direction, the leading end of the sheet P contacts the conveyance roller and the sheet is not smoothly conveyed to the nip region of the pair of sheet conveying rollers, causing increase of paper jam. The above-described configuration is provided to avoid the above-described situation.

A sheet bundle in which a plurality of sheets having a large thickness deviation in the sheet conveying direction is stacked, resulting in spreading in a fan shape in a thicker thickness. If the fan-shaped side of the sheet bundle is set in the trailing end side in the sheet conveying direction of the sheet tray 10, the following inconvenience occurs.

Figure 6:
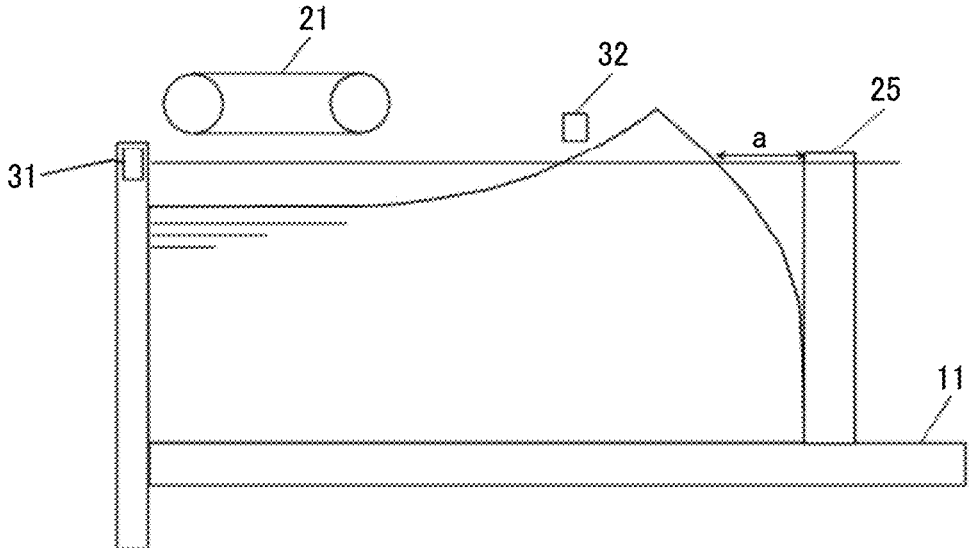
FIG. 6 is a schematic diagram illustrating a comparative sheet feeding device in which a sheet bundle is spread in a fan shape.

FIG. 6 is a schematic diagram illustrating a comparative sheet feeding device in which a sheet bundle is spread in a fan shape.

As described above, since the thick side of the sheet is set in the trailing end side in the sheet conveying direction for the conveyance capability, the sheet bundle is set in the sheet tray such that the side spreading in a fan shape of the sheet bundle is set in the trailing end side of the sheet conveying direction, as illustrated in FIG. 6. Then, even if the end fence 25 is moved in the sheet conveying direction to regulate the sheet bundle, a gap "a" is created between the upper side of the sheet bundle P and the end fence 25, and the position of the upper side of the sheet bundle is no longer regulated by the end fence 25. When the gap a is generated as described above, the floating uppermost sheet recedes by the gap "a", an uppermost sheet and the leading end of a subsequent sheet face the attraction belt 21, and the leading end of the second sheet is attracted to the attraction belt 21 together with the uppermost sheet. As a result, there is an inconvenience disadvantage that the two sheets (in other words, the uppermost sheet and the second sheet) are conveyed and multifeeding occurs.

Furthermore, the height of the sheet bundle loaded on the sheet loading table 11 is higher on the trailing end side than on the leading end side. An end sensor 32 is disposed upstream from the attraction belt 21 in the sheet conveying direction to detect the presence or absence of a sheet and the sheet end. When the height of the sheet bundle P loaded on the sheet loading table 11 becomes higher on the trailing end side than on the leading end side, the end sensor 32 detects presence of a sheet. However, there may be a case in which the sheet detection sensor 31 detects absence of a sheet, and therefore the elevation control may not be performed properly.

Furthermore, since the sheets in the upper portion of the sheet bundle are largely curved upward toward the trailing end of the sheets, downward restoring force is exerted at the leading end side of the sheets. As a result, the leading end of the sheets hardly floats up, and it is unlikely that the uppermost sheet is attracted to the attraction belt 21.

As described above, when sheets having a thickness deviation in multiple sheet conveying directions are bundled, the fan-shaped spread becomes large and the above-described inconvenience occurs. Therefore, when forming an image on a sheet having a large thickness deviation in the sheet conveying direction, a bundle of a few sheets can be set on the sheet tray 10 so that the productivity is low.

Therefore, in the present embodiment, even if a sheet bundle including sheets having a thickness deviation in multiple sheet conveying directions is set in the sheet tray 10, the sheet is preferably conveyed without causing the above-described inconvenience.

A detailed description of the sheet feeding device 200 is described below.

Figure 7:
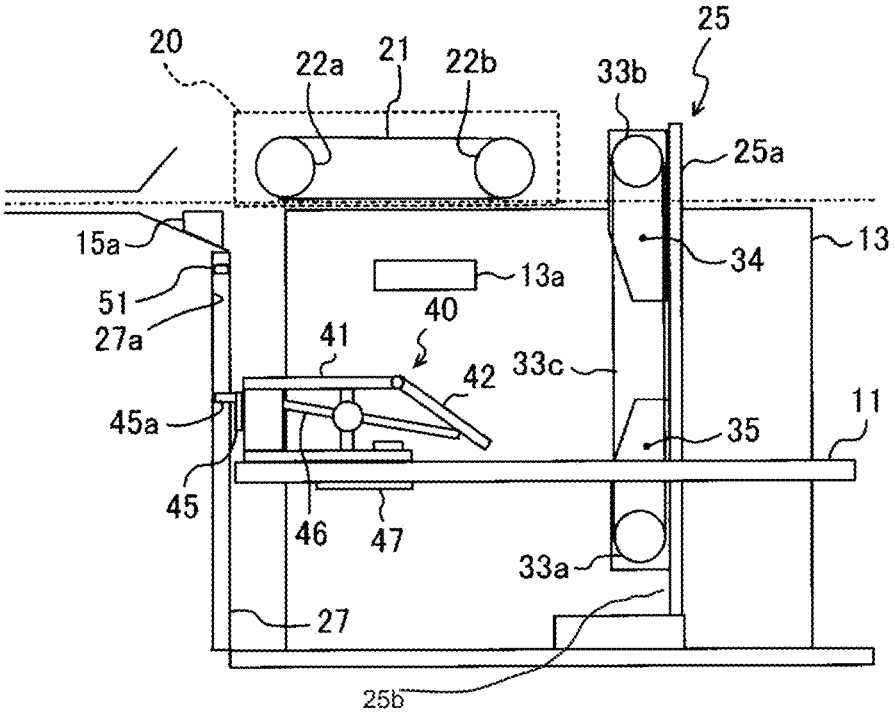
FIG. 7 is a diagram illustrating a schematic configuration of the sheet feeding device according to the present embodiment.
Figure 8:
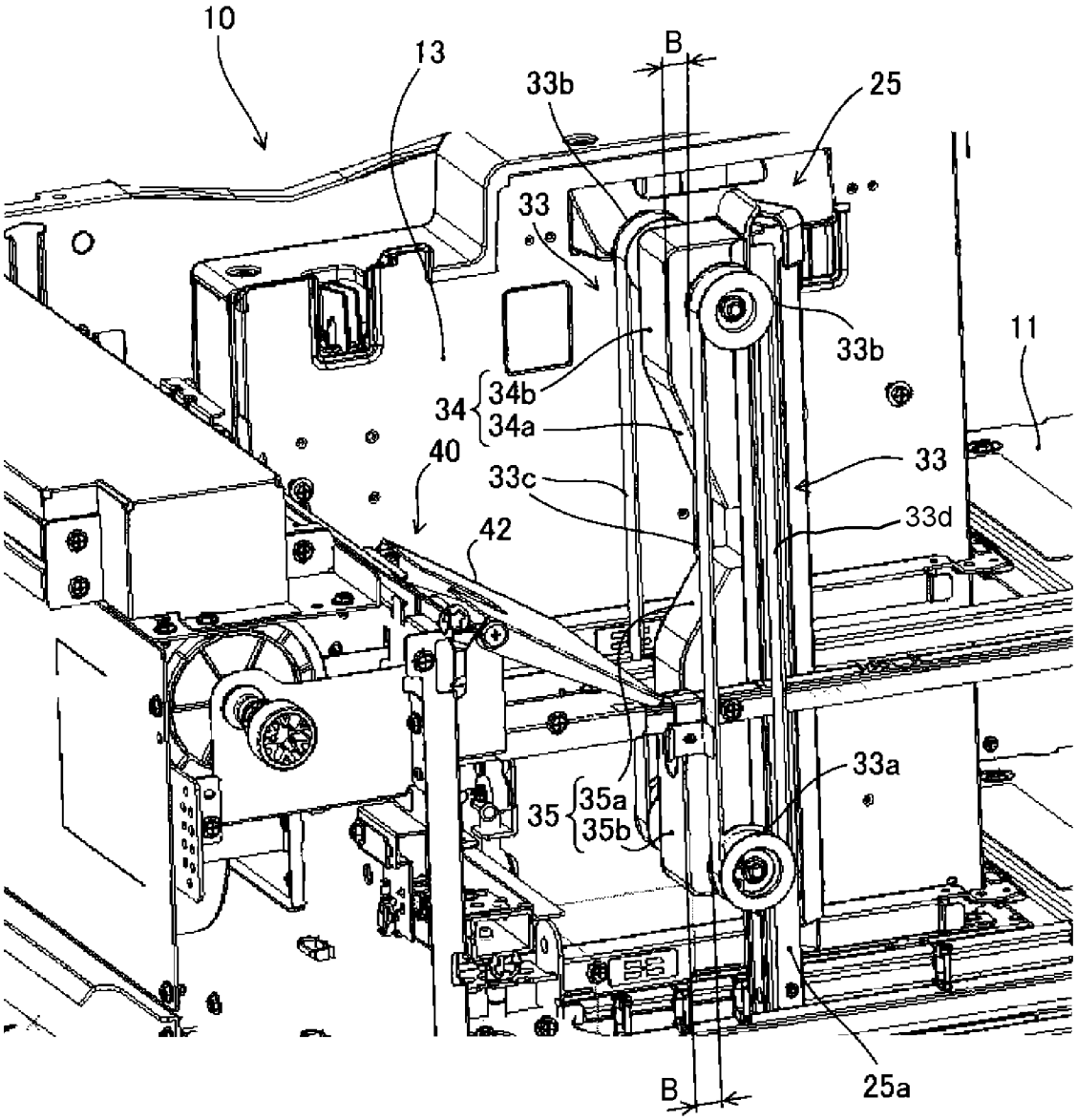
FIG. 8 is a schematic perspective view illustrating an area near the sheet tray.

FIG. 7 is a diagram illustrating a schematic configuration of the sheet feeding device 200 according to the present embodiment. FIG. 8 is a schematic perspective view illustrating an area near the sheet tray 10.

As illustrated in FIGS. 7 and 8, the end fence 25 according to the present embodiment includes a support 25*a* supported at the bottom of the sheet tray 10 so as to be movable in the sheet conveying direction. The facing surface 25*b* of the support 25*a* facing the sheet bundle has a lower regulating member 35 that functions as a lower regulator to contact or abuts on a trailing end of the lower side of the sheet bundle P to regulate the position of the trailing end of the lower side of the sheet bundle P, and an upper regulating member 34 that functions as an upper regulator to contact on the trailing end of the upper side of the sheet bundle P to regulate the position of the trailing end of the upper side of the sheet bundle P.

A pair of belt regulating units 33 is disposed on both sides in the sheet width direction of each regulating member. Specifically, a belt regulating unit 33 is disposed on one side in the sheet width direction of both of the upper regulating member 34 and the lower regulating member 35, and another belt regulating unit 33 is disposed on the other side in the sheet width direction of both of the upper regulating member 34 and the lower regulating member 35. Each belt regulating unit 33 includes an upper stretching roller 33*b* rotatably supported by the upper regulating member 34, a lower stretching roller 33*a* rotatably supported by the lower regulating member 35, and a belt 33*c* as an elastic body stretched between the lower stretching roller 33*a* and the upper stretching roller 33*b*.

The configurations of the belt regulating units 33 are the same, and the tension of the belt 33*c* of one of the belt regulating units 33 on one side and the tension of the belt 33*c* of another one of the belt regulating units 33 on the other side are the same. The tension of the belt 33*c* is preferably weak. Due to the weak tension of the belt 33*c*, elastic deformation is performed easily, and following to the fan-shaped spread of the trailing end of the sheet bundle P is performed. It is to be noted that, due to weak tension, the belt 33*c* does not regulate the position of the trailing end correctly, and the leading end of the sheet bundle P is not pressed against the front fence 27. However, in the present embodiment, the upper regulating member 34 is provided, the position of the trailing end is regulated correctly by the upper regulating member 34, and inconveniences including multifeeding do not occur.

A plurality of holes for rotatably supporting the stretching roller (i.e., the upper stretching roller 33*b* or the lower stretching roller 33*a*) may be provided in at least one of the upper regulating member 34 and the lower regulating member 35 in a row in the vertical direction so that the tension of the belt 33*c* is adjusted. In other words, the upper regulating member 34 and the lower regulating member 35 function as a belt tension adjuster to adjust tension of the belt 33*c*. In such a configuration, the tension applied to the belt 33*c* is adjusted by changing the hole for supporting the stretching roller (i.e., the upper stretching roller 33*b* or the lower stretching roller 33*a*).

Since each of the lower stretching roller 33*a* and the upper stretching roller 33*b* is rotatably supported by the regulating member, as described later, the belt 33*c* that contacts on the trailing end of the sheet moves endlessly following the rising of the sheet P. Since the surface of the belt 33*c* is rough and uneven, the sheet P in contact with the belt 33*c* is unlikely to slip on the surface of the belt 33*c*.

As illustrated in FIG. 8, the upper regulating member 34 is attached to the upper portion of the support 25*a*, and the surface facing the sheet bundle has a contact face 34*b* parallel to the vertical direction and a sloped guide face 34*a* that functions as a slope and is inclined so as to be located in a direction away from the sheet bundle P toward a downward side from the lower end of the contact face 34*b*.

The lower regulating member 35 has the same shape as the upper regulating member 34, and is attached to the lower portion of the support 25*a* so as to be in a vertically opposite posture from the posture of the upper regulating member 34. Therefore, a sloped guide face 35*a*, which functions as a slope, of the lower regulating member 35 is a surface inclined so as to be located in a direction away from the sheet bundle toward an upward direction from the upper end of a contact face 35*b*.

The contact face 34*b* of the upper regulating member 34 and the contact face 35*b* of the lower regulating member 35 are located on B mm to the sheet bundle side from the stretching region on the sheet bundle side of the belt 33*c*.

A loading unit 40 is attached to the downstream side of the sheet conveying direction of the sheet loading table 11 as an elevation body. The loading unit 40 has a fixed table 41 that supports the leading end side in the sheet conveying direction of the sheet bundle P, and a movable table 42 that is rotated by a link mechanism 48. The link mechanism 48 has a first rotation member 45 and a second rotation member 46 (in other words, a plurality of links), and the first rotation member 45 has a movable projection 45*a* that moves the movable table 42 by contacting the projection 51 provided in a guide groove 27*a* for guiding the sheet loading table 11 of the front fence 27.

Figure 9:
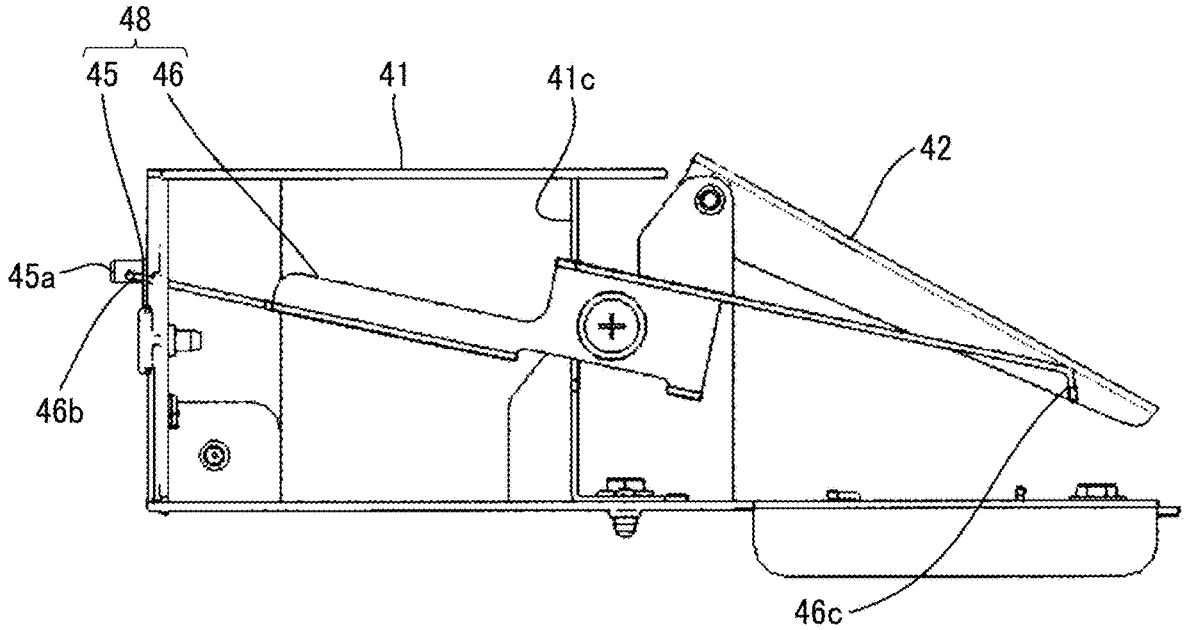
FIG. 9 is a diagram illustrating a schematic configuration of a sheet loading unit.
Figure 10:
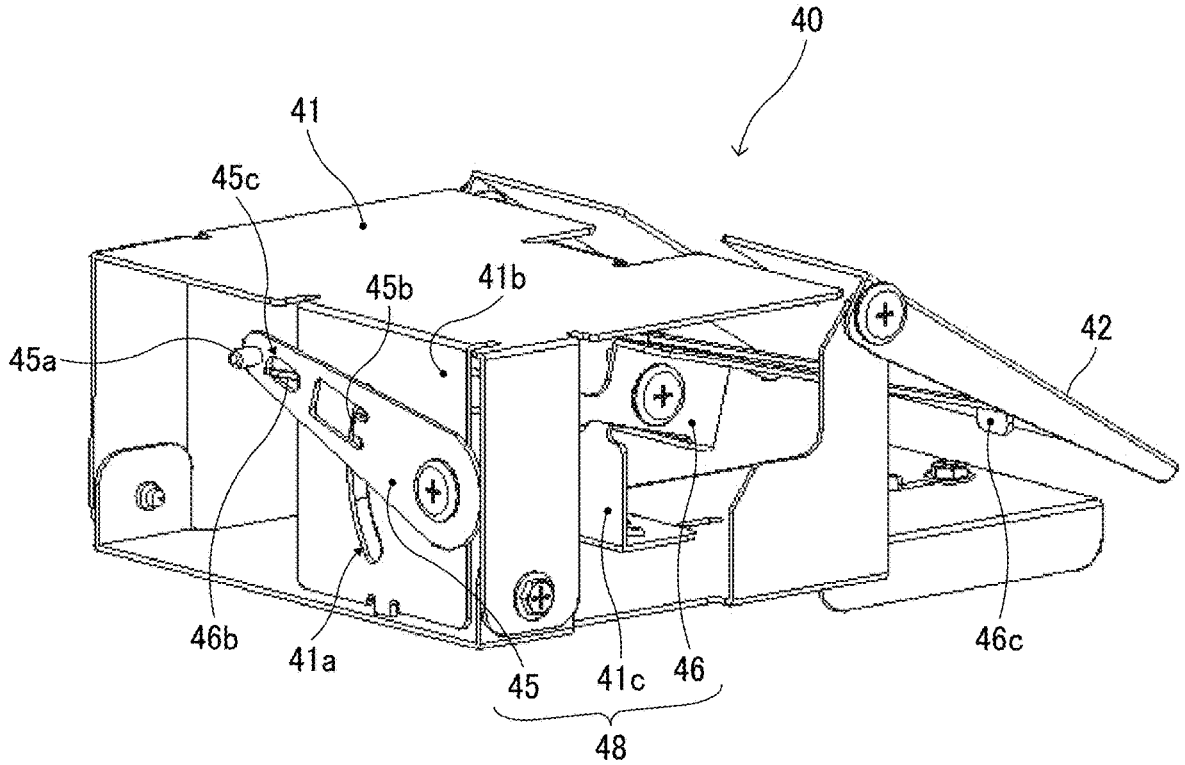
FIG. 10 is a perspective view illustrating the sheet loading unit.

FIG. 9 is a diagram illustrating the schematic configuration of the loading unit 40. FIG. 10 is a perspective view illustrating the loading unit 40.

One end of the first rotation member 45 included in the link mechanism 48 is rotatably supported by an opposed face 41*b* facing the front fence 27. A movable projection 45*a* is provided on the other end of the first rotation member 45 that functions as a link. A through hole 45*c* through which a connecting part 46*b* of the second rotation member 46 passes is provided adjacent to the movable projection 45*a*.

A regulating hole 41*a* for restricting the rotation range of the first rotation member 45 is provided in the opposed face 41*b*, and a regulating projection 45*b* is inserted into the regulating hole 41*a*. The regulating projection 45*b* is provided at the substantially center of the first rotation member 45 and is formed in a shape to be bent toward the upstream side of the sheet conveying direction. By such a configuration, the rotation range of the first rotation member 45 is restricted to less than 90 degrees.

A substantially central portion of the second rotation member 46 that functions as a link is rotatably supported by a table support 41*c* that supports the upstream side of the sheet conveying direction of the fixed table 41. As described above, the connecting part 46*b* coupled to the first rotation member 45 is formed at the downstream end in the sheet conveying direction of the second rotation member 46. On the upstream end in the sheet conveying direction of the second rotation member 46, a contact part 46*c* is provided for contacting the rear surface of the movable table 42 and rotating the movable table 42.

The connecting part 46*b* of the second rotation member 46 is coupled to the first rotation member 45 whose rotating range is regulated. Therefore, the rotation range of the second rotation member 46 is also regulated to less than 90 degrees. As described above, by setting the rotation range of each rotation member included in the link mechanism 48 to less than 90 degrees, the increase in size of the loading unit 40 is restrained.

When the movable projection 45*a* is not in contact with the projection 51, the weight of the movable table 42 pushes the contact part 46*c* of the second rotation member 46, and lowers the contact part 46*c*, so that the movable table 42 is in an inclined (sloped) posture. The second rotation member 46 is in a posture in which the contact part 46*c* is lowered and the connecting part 46*b* is lifted, and the first rotation member 45 is in a posture in which the movable projection 45*a* is located upward.

Figure 11:
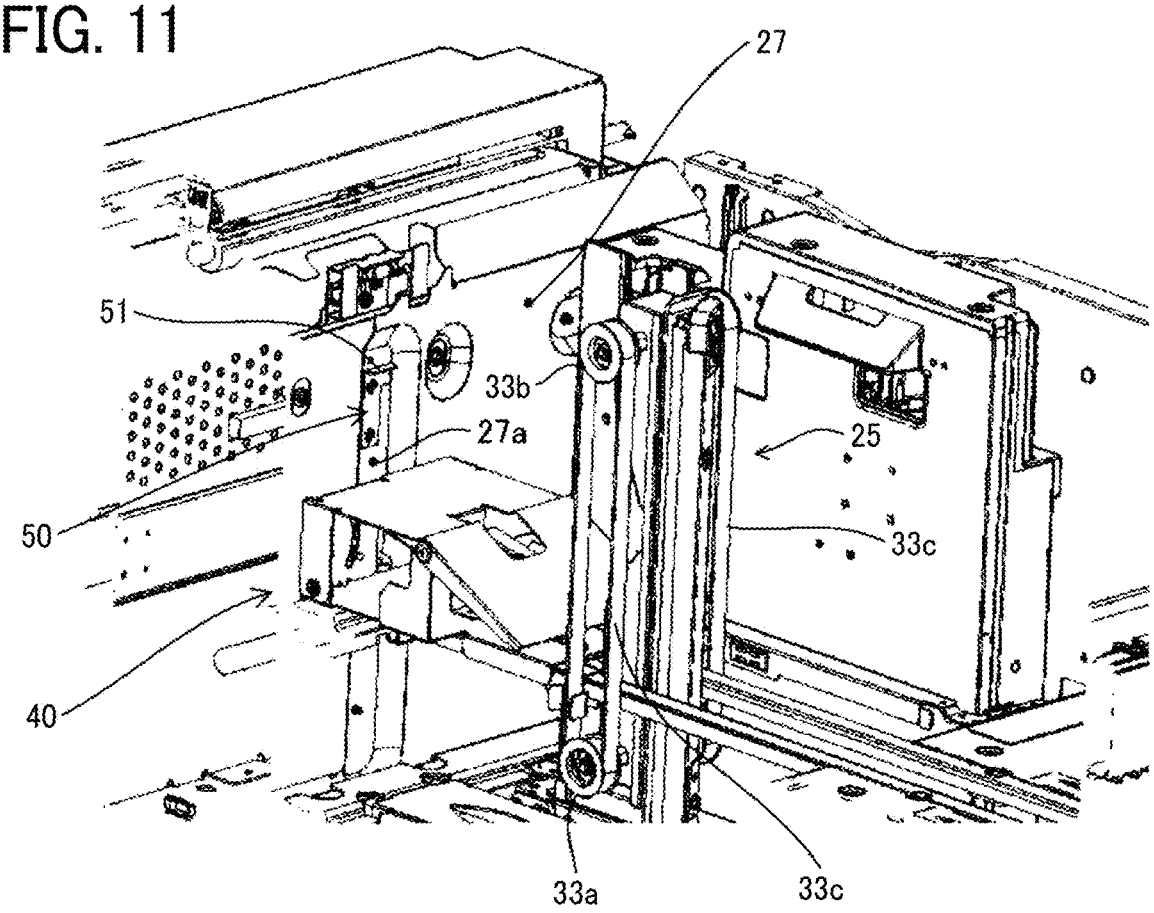
FIG. 11 is a perspective view illustrating the sheet tray, viewed from an upstream side of a sheet conveying direction.

FIG. 11 is a perspective view illustrating one of the sheet rays 10, viewed from an upstream side of the sheet conveying direction.

As illustrated in FIG. 11, a stopper 50 having a projection 51 is screwed in the upper portion of the guide groove 27*a* that guides lifting and lowering of the sheet loading table 11 of the front fence 27 on which the leading end of the sheet bundle P of the sheet tray 10 contacts and which regulates the position of the leading end of the sheet bundle P.

Figure 12:
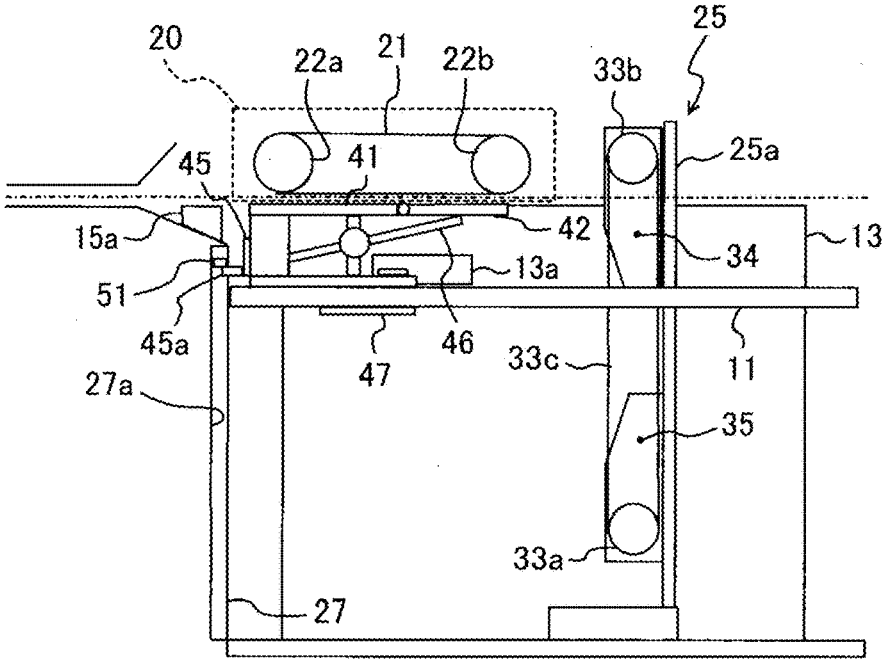
FIG. 12 is a diagram illustrating a schematic configuration of the sheet feeding device when a fixed base reaches a sheet feeding position.
Figure 13:
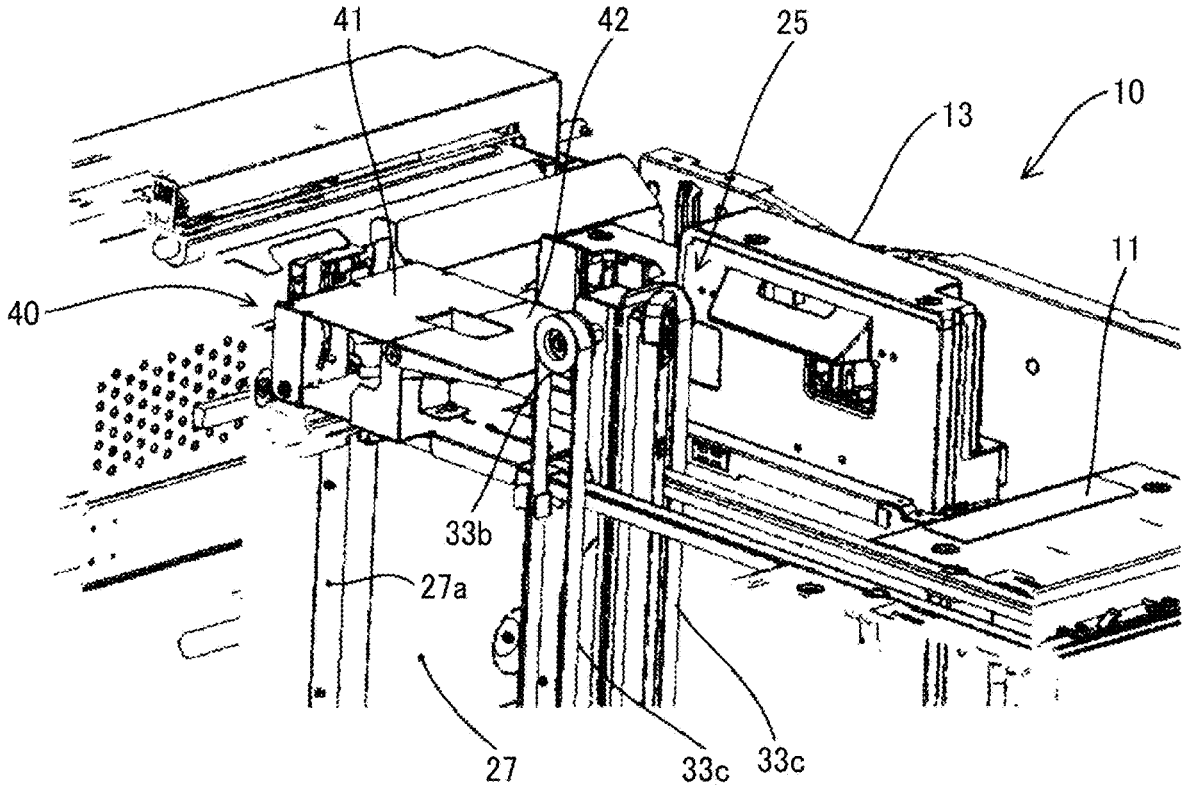
FIG. 13 is a perspective view illustrating the sheet tray; viewed from the upstream side of the sheet conveying direction, when the fixed base reaches the sheet feeding position.
Figure 14:
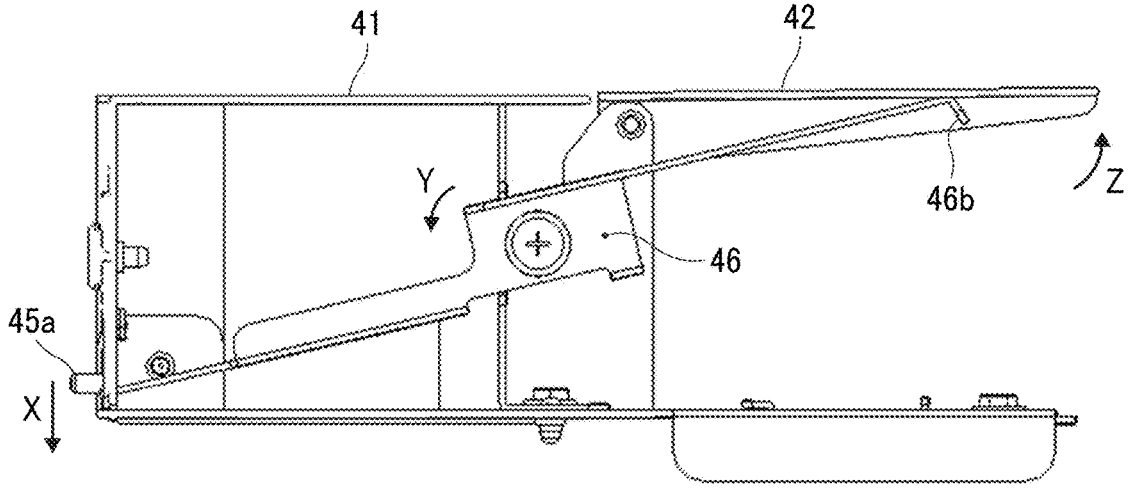
FIG. 14 is a schematic diagram illustrating the sheet loading unit when the fixed base reaches the sheet feeding position.
Figure 15:
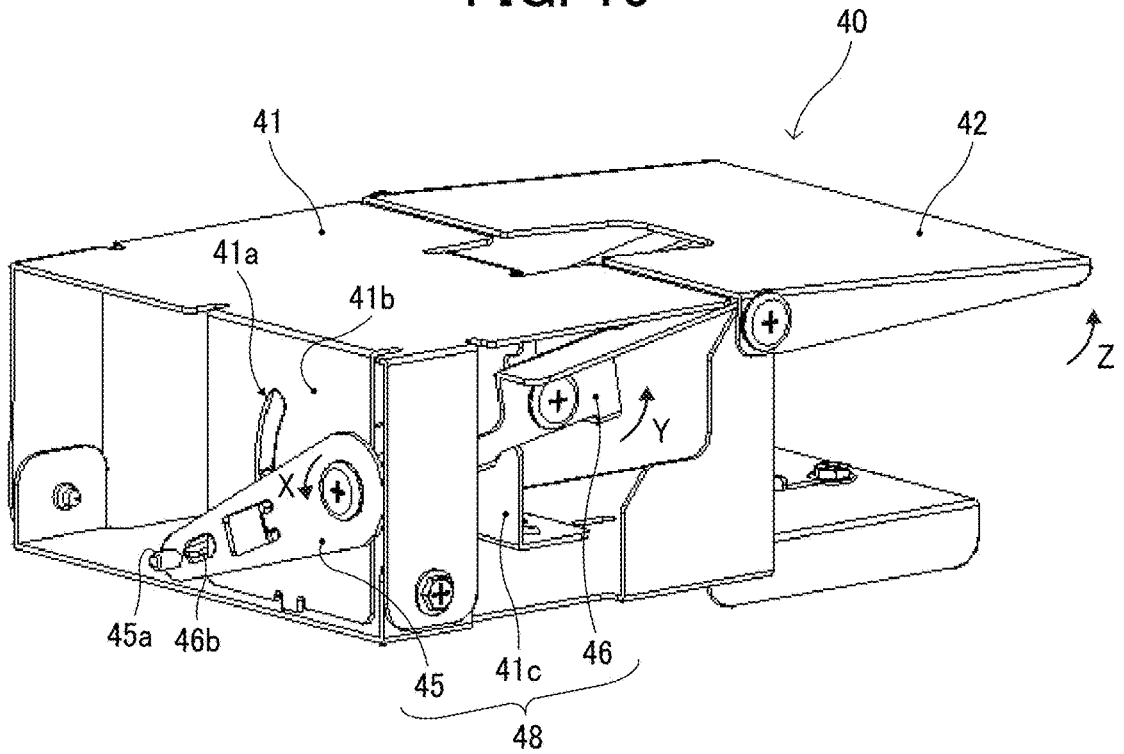
FIG. 15 is a perspective view illustrating the sheet loading unit when the fixed base reaches the sheet feeding position.

FIG. 12 is a diagram illustrating a schematic configuration of the sheet feeding device 200 when the fixed table 41 reaches a sheet feeding position. FIG. 13 is a perspective view illustrating the sheet tray 10, viewed from the upstream side of the sheet conveying direction, when the fixed table 41 reaches the sheet feeding position. FIG. 14 is a schematic diagram illustrating the loading unit 40 when the fixed table 41 reaches the sheet feeding position. FIG. 15 is a perspective view illustrating the loading unit 40 when the fixed table 41 reaches the sheet feeding position.

As the loading unit 40 attached to the sheet loading table 11 is lifted together with the sheet loading table 11, the movable projection 45*a* contacts on the projection 51. When the loading unit 40 is further lifted from this state, the projection 51 regulates lifting of the movable projection 45*a*. Then, the first rotation member 45 rotates in the direction indicated by arrow X in FIGS. 14 and 15 against the weight of the movable table 42 and the sheet bundle mounted on the loading unit 40 as illustrated in FIG. 14, and the movable projection 45*a* moves downward relative to the loading unit 40. As the first rotation member 45 rotates in the direction X in FIGS. 14 and 15, the connecting part 46*b* of the second rotation member 46 is pushed down. As a result, as illustrated in FIGS. 13 and 14, the second rotation member 46 rotates in the direction indicated by arrow Y in FIGS. 14 and 15, and the contact part 46*c* lifts the movable table 42. As a result, the movable table 42 rotates in the direction indicated by arrow Z in FIGS. 14 and 15, and the slope inclination becomes gentler. Then, as illustrated in FIG. 12, when the fixed table 41 reaches the sheet feeding position, the movable table 42 is in a horizontal posture.

Since the configuration of the present embodiment includes the link mechanism 48 and the movable table 42 is rotated as the sheet loading table 11 is lifted, a motor for rotationally driving the movable table 42 is omitted, and therefore the cost of the device is reduced.

Figure 16:
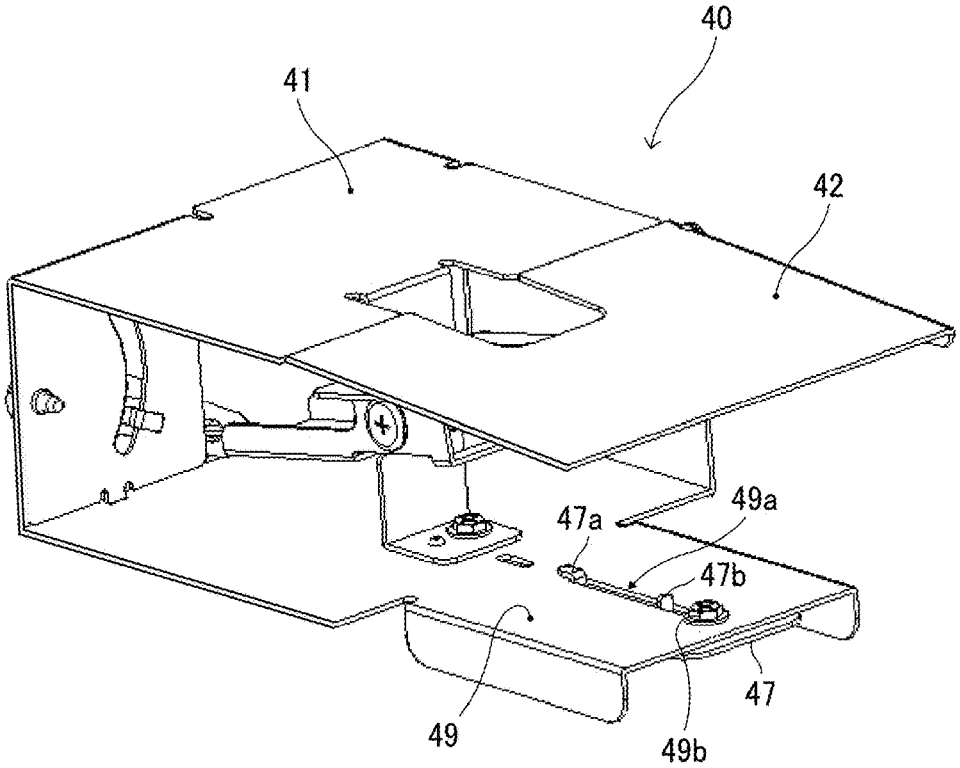
FIG. 16 is a cross-sectional perspective view illustrating the sheet loading unit, viewed from the upstream side of the sheet conveying direction.
Figure 17A:
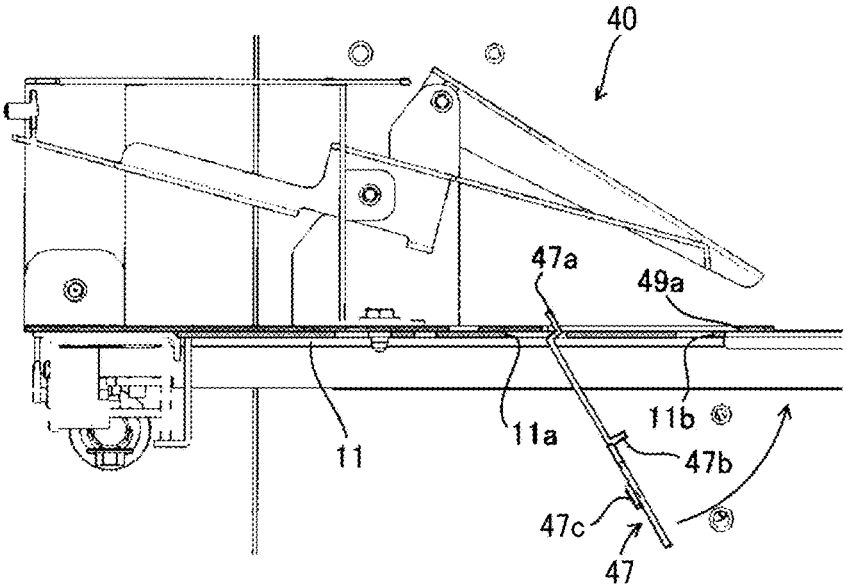
FIGS. 17A, 17B, and 17C are diagrams for explaining how to mount the sheet loading unit onto a sheet loading table.
Figure 17B:
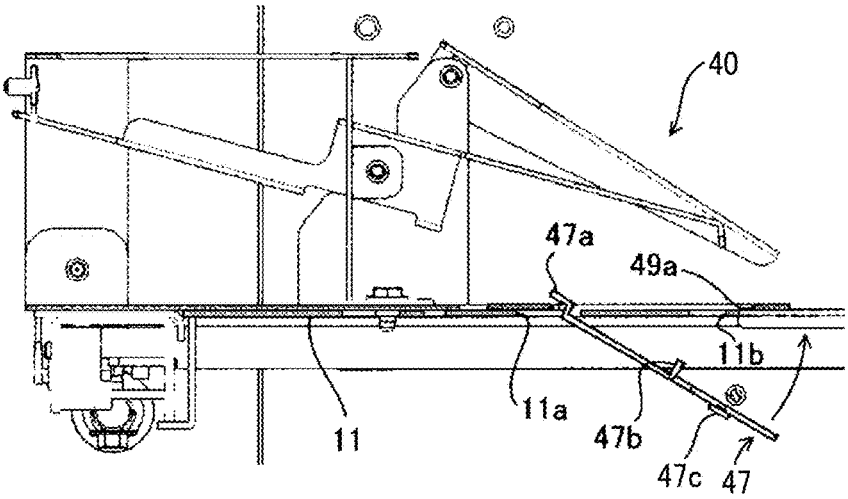
Figure 17C:
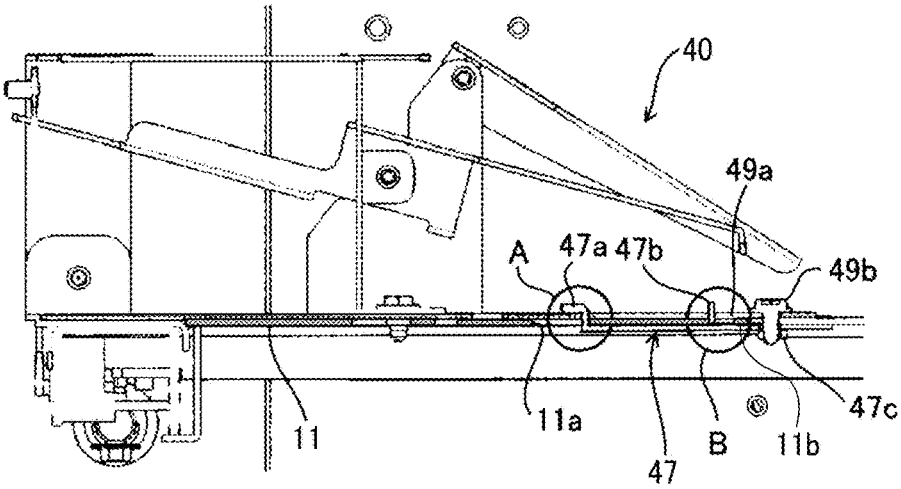
Figure 18A:
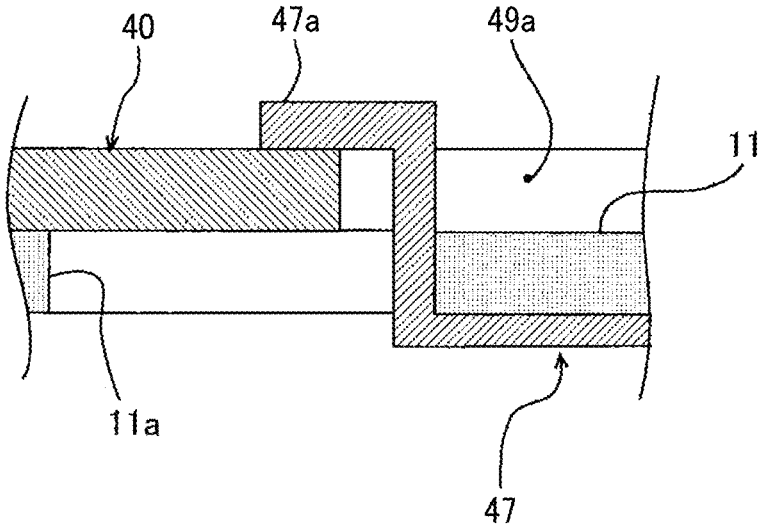
FIG. 18A is an enlarged view illustrating a part A of FIG. 17C.
Figure 18B:
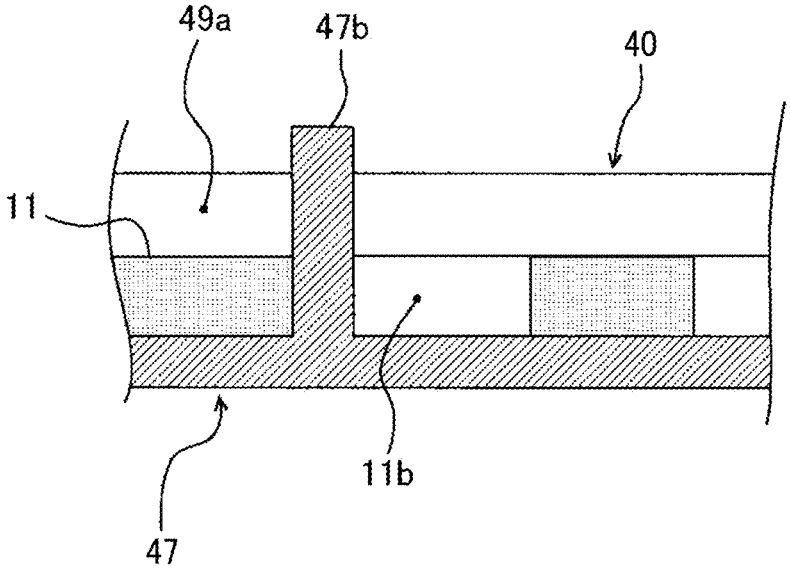
FIG. 18B is an enlarged view illustrating a part B of FIG. 17C.

FIG. 16 is a cross-sectional perspective view illustrating the loading unit 40, viewed from the upstream side of the sheet conveying direction. FIGS. 17A, 17B, and 17C are diagrams for explaining how to mount the loading unit 40 onto the sheet loading table 11. FIG. 18A is an enlarged view illustrating a part A of FIG. 17C and FIG. 18B is an enlarged view illustrating a part B of FIG. 17C.

As illustrated in FIG. 16, a fixing part 49 for fixing the loading unit 40 to the sheet loading table 11 is provided on the upstream side in the sheet conveying direction of the loading unit 40. The fixing part 49 has a long slot 49*a* extending in the sheet conveying direction.

The loading unit 40 is attached to the sheet loading table 11 using a unit fixing plate 47.

A hook-shaped fixing claw 47*a* and a positioning convex 47*b* are provided on the downstream end in the sheet conveying direction of the unit fixing plate 47.

First, as illustrated in FIG. 17A, the fixing claw 47*a* of the unit fixing plate 47 is inserted into the long slots 49*a* of the loading unit 40 from the lower side of the sheet loading table 11. As illustrated in FIG. 17A, the sheet loading table 11 has a first hole 11*a* and a second hole 11*b*, and the fixing claw 47*a* of the unit fixing plate 47 is inserted into the long slot 49*a* through the first hole 11*a*.

Next, after the fixing claw 47*a* is abutted or contracted on the downstream end of the sheet conveying direction of the long slot 49*a*, as illustrated in FIGS. 17A and 17B, the unit fixing plate 47 is rotated in a clockwise direction in FIGS. 17A and 17B with the fixing claw 47*a* as a fulcrum, and the positioning convex 47*b* of the unit fixing plate 47 is penetrated through the second hole 11*b* of the sheet loading table 11 and the long slot 49*a* of the loading unit 40. The length from the fixing claw 47*a* to the positioning convex 47*b* is almost equal to the length from the upstream end in the sheet conveying direction of the first hole 11*a* of the sheet loading table 11 to the downstream end in the sheet conveying direction of the second hole 11*b*. Therefore, when the positioning convex 47*b* is penetrated through the second hole 11*b*, the fixing claw 47*a* contacts the upstream end in the sheet conveying direction of the first hole 11*a* as illustrated in FIG. 18A. Accordingly, the positioning convex 47*b* contacts the upstream end in the sheet conveying direction of the second hole 11*b* as illustrated in FIG. 18B, so that the unit fixing plate 47 is positioned in the sheet conveying direction. Then, as illustrated in FIG. 17C, by screwing the screw 49*b* into the screw hole 47*c* of the unit fixing plate 47, the bottom surface of the loading unit 40 is pushed to the sheet loading table 11 side by the fixing claw 47*a* and the head of the screw 49*b*. Thus, the loading unit 40 is attached to the sheet loading table 11 such that the portion between the first hole 11*a* and the second hole 11*b* of the sheet loading table 11 is sandwiched between the loading unit 40 and the unit fixing plate 47.

When the loading unit 40 is fixed to the unit fixing plate 47 positioned on the sheet loading table 11, the loading unit 40 is positioned and fixed on the sheet loading table 11. The loading unit 40 is an extension unit used when setting a sheet bundle including sheets having a thickness deviation in the sheet conveying direction to the sheet tray 10, and is removed from the device when a sheet bundle including sheets having no thickness deviation in the sheet conveying direction is set to the sheet tray 10.

In the present embodiment, since the loading unit 40 is attached to the sheet loading table 11 with one screw, the loading unit 40 is easily attached to and removed from the sheet loading table 11. Therefore, extension is made easily into a device in which a sheet bundle including sheets having a thickness deviation in the sheet conveying direction is set to the sheet tray 10.

Figure 19:
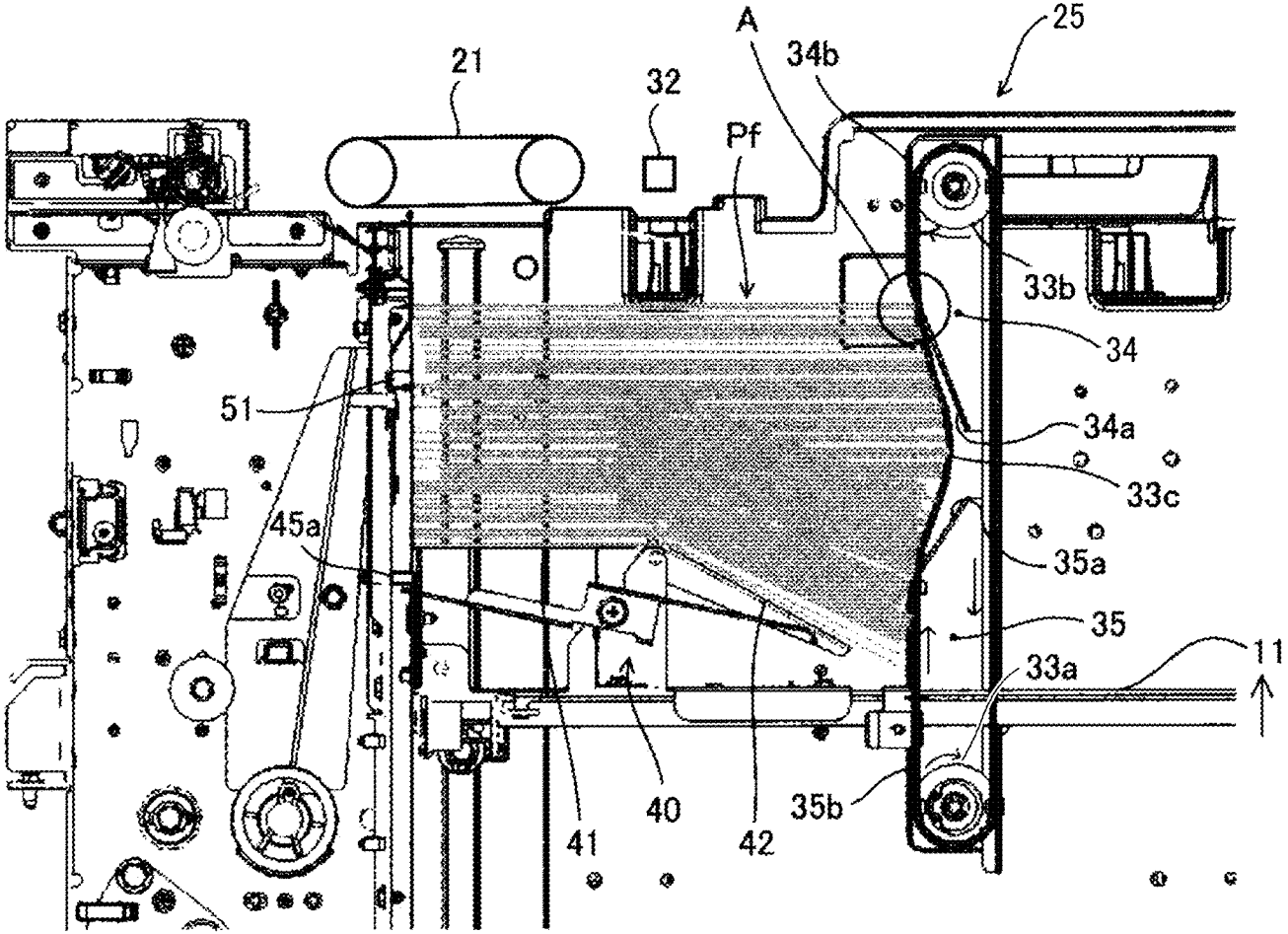
FIG. 19 is a side view illustrating a state in which a sheet bundle including sheets having a thickness deviation in the sheet conveying direction is set.
Figure 20B:
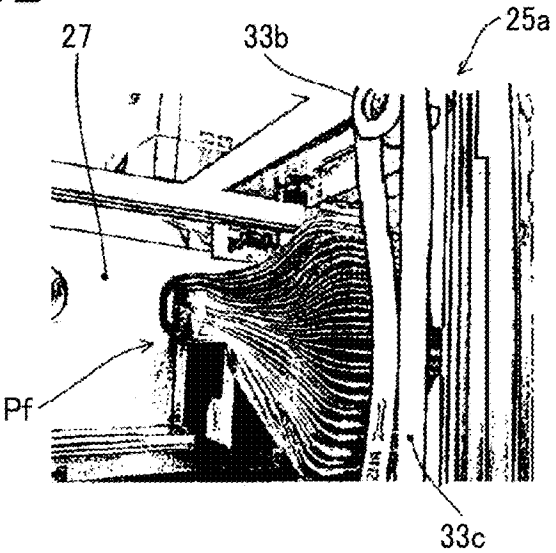
FIGS. 20A, 20B, 20C, and 20D are perspective views illustrating the sheet tray in which the sheet bundle including sheets having a thickness deviation in the sheet conveying direction is set, viewed from different angles.
Figure 20D:
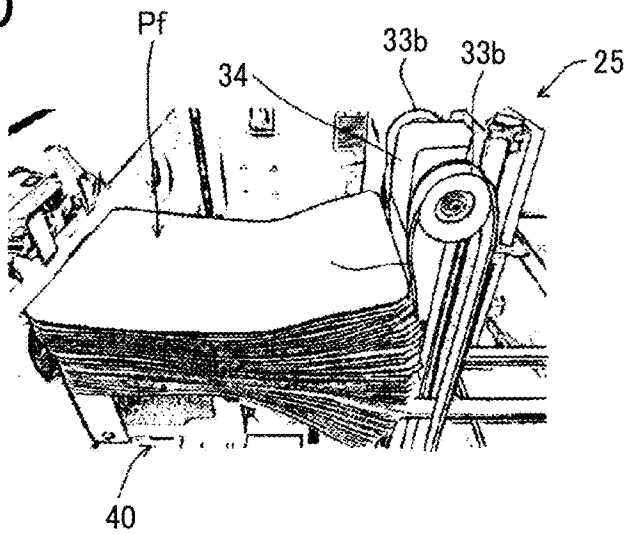
Figure 20A:
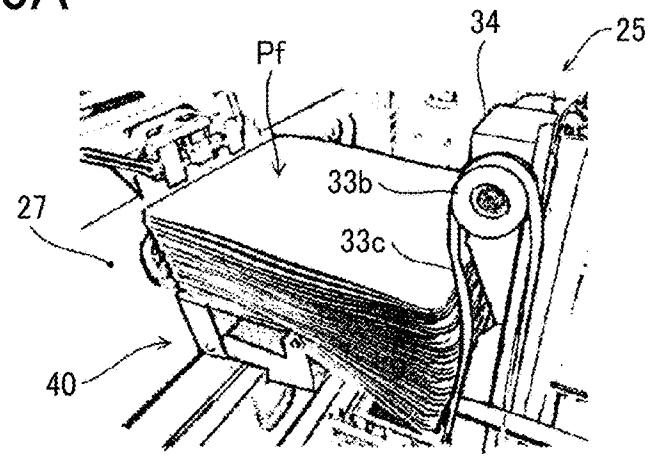
Figure 20C:
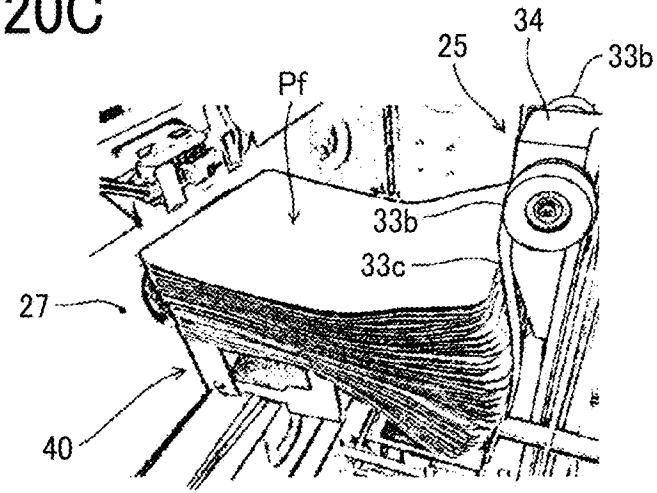

FIG. 19 is a side view illustrating a state in which a sheet bundle Pf including sheets having a thickness deviation in the sheet conveying direction is set. FIGS. 20A, 20B, 20C, and 20D are perspective views illustrating one of the sheet trays 10 in which the sheet bundle including sheets having a thickness deviation in the sheet conveying direction is set, viewed from different angles.

In the present embodiment, when the number of sheets in the sheet bundle Pf is large and the fan-shaped opening on the trailing end side is large, the sheet loading table 11 is located in the lower portion, and the movable projection 45*a* of the mounting unit is separated from the projection 51, as illustrated in FIG. 19. Therefore, at this time, the movable table 42 is inclined. Accordingly, as illustrated in FIGS. 19 and 20A-20D, the trailing end side of the lower part of the sheet bundle Pf is inclined following the slope of the movable table 42. As a result, the fan-shaped spread of the trailing end side of the upper part of the sheet bundle Pf is more restrained compared to the comparative configuration, illustrated in FIG. 6. Thus, a situation in which the sheet detection sensor 31 detects the absence of a sheet while the end sensor 32 detects the presence of a sheet is prevented from occurring, and therefore the lifting and lowering of the sheet loading table 11 is preferably controlled.

Since the trailing end side of the upper part of the sheet bundle Pf is restrained from curling, the restoring force is reduced to the leading end side of the lower part of the sheet bundle Pf, and the uppermost sheet is preferably floated to be attracted to the attraction belt 21.

In the present embodiment, the end fence 25 includes the belt regulating unit 33.

As a result, even when the positions in the sheet conveying direction of the trailing end of the sheet bundle Pf varies in the vertical direction because the trailing end side of the sheet bundle Pf spreads like a fan, the belt 33*c*, functioning as an elastic body, of the belt regulating unit 33 elastically deforms following in the fan shape of the trailing end side of the sheet bundle Pf, and the end fence 25 is brought to contact the trailing end of the sheet bundle Pf without any gap.

In the present embodiment, since the slope of the movable table 42 does not completely absorb the fan-shaped spread on the trailing end side of the sheet bundle Pf, the trailing end side of both the upper and lower parts of the sheet bundle Pf set in the sheet tray 10 has a shape to spread, and the center part of the sheet bundle Pf is located in the extreme upstream side in the sheet conveying direction, as illustrated in FIGS. 20A to 20D.

In the present embodiment, the upper and lower portions of the end fence 25 have regulating members that do not elastically deform, and the regulating members project more than the belt 33*c*, while the belt 33*c* projects more than the regulating members in the center portion in the vertical direction of the end fence 25. As a result, the center portion in the vertical direction of the end fence 25, the trailing end of which is located in the extreme upstream side in the sheet conveying direction, contacts the belt 33*c*, so that the belt 33*c* elastically deforms so as to be recessed in the upstream side of the sheet conveying direction. Thus, even after the vertical center portion of the end fence 25 contacts the belt 33*c*, the end fence 25 is moved to the downstream side in the sheet conveying direction, the contact face 34*b* of the upper regulating member 34 is contacted on the trailing end of the upper part of the sheet bundle Pf, and the contact face 35*b* of the lower regulating member 35 is contacted on the trailing end of the lower part of the sheet bundle Pf.

Since the tensions of the belts 33*c* of the belt regulating units 33 are the same, the elastic forces applied to the sheet bundle when the end fence 25 is contacted on the sheet bundle equals to each other, and the bending of the sheet is restrained.

By configuring the tension of the belt 33*c* to be adjustable, for example, in the sheet having weak hardness, the tension of the belt 33*c* is weakened, and the curving or curling of the sheet due to the elastic force of the belt 33*c* is restrained.

In the present embodiment, the belt 33*c* is supported by the upper stretching roller 33*b* and the lower stretching roller 33*a* so as to be movable endlessly. Therefore, when the sheet loading table 11 is lifted to feed the sheet from the state illustrated in FIG. 19, the frictional force with the trailing end of the sheet bundle causes the belt 33*c* to rotate in the clockwise direction as indicated by arrow in FIG. 19. As a result, the sheet bundle is lifted smoothly.

In the present embodiment, since the vertical center portion of the belt 33*c* is recessed in the upstream side of the sheet conveying direction, the upper side of the belt 33*c* is inclined toward the downstream side of the sheet conveying direction. According to this configuration, the sheet bundle is resisted or prevented from being lifted. In addition, the belt 33*c* is made of a rubber material and has large sliding resistance with the sheet. Accordingly, in a case in which the belt 33*c* does not move endlessly, a defect such as bending of the trailing end of the sheet downward may occur when the sheet bundle is lifted. Therefore, as in the present embodiment, the belt 33*c* is movable endlessly, and the belt 33*c* is endlessly moved as the lifting of the sheet bundle, so that a defect such as bending of the trailing end of the sheet toward the downward direction is effectively prevented.

Moreover, in the present embodiment, since the surface of the belt 33*c* is rough to be uneven, the belt 33*c* reliably moves endlessly as the sheet bundle is lifted, and therefore the sheet bundle is lifted smoothly.

Furthermore, in the present embodiment, the contact face 34*b* of the upper regulating member 34 is located closer to the sheet bundle than the belt 33*c*. Therefore, as the sheet bundle is being lifted, the part that the trailing end of the sheet bundle contacts is switched from the belt 33*c* to the upper regulating member 34.

In the present embodiment, the lower end of the contact face 34*b* of the upper regulating member 34 has the sloped guide face 34*a* so as to be located on the upstream side in the sheet conveying direction toward the downward direction.

Figure 21:
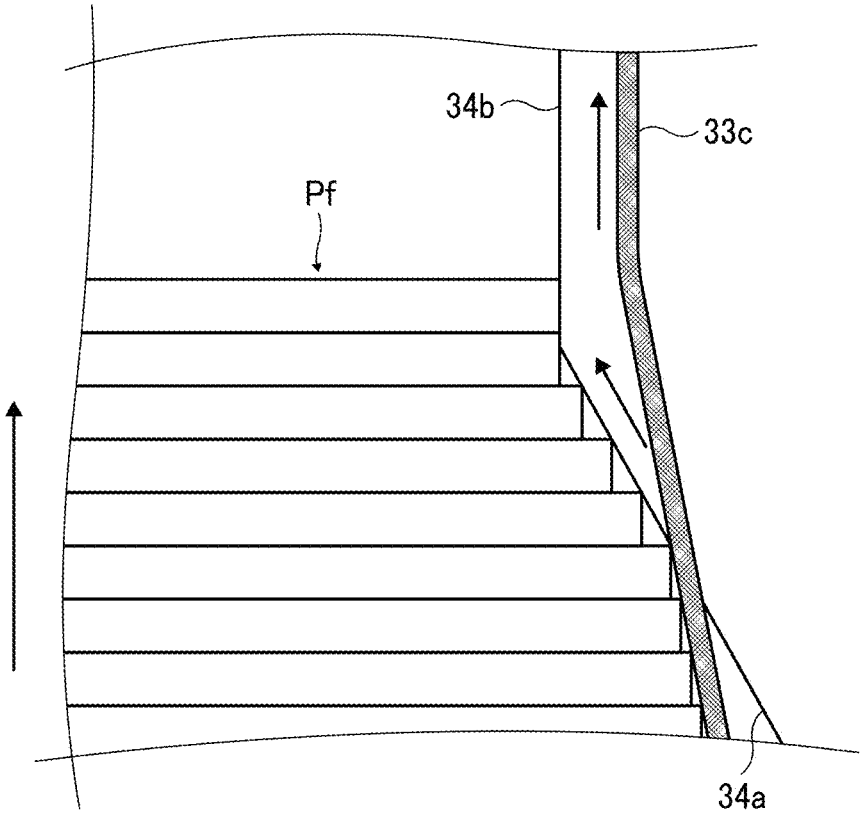
FIG. 21 is an enlarged view illustrating the part A of FIG. 19.

FIG. 21 is an enlarged view illustrating of the part A of FIG. 19.

As illustrated in FIG. 21, by providing the sloped guide face 34*a* in the upper regulating member 34, the sheet is delivered smoothly from the belt 33*c* to the upper regulating member 34, and at the time of delivery from the belt 33*c* to the upper regulating member 34, a defect such as bending of the trailing end of the sheet in the downward direction by being hooked on the upper regulating member 34 is restrained.

Similarly, in the lower regulating member 35, by lifting the sheet bundle, the part that the sheet trailing end of the sheet bundle contacts is switched from the lower regulating member 35 to the belt 33*c*. In the present embodiment, the lower regulating member 35 is also provided with the sloped guide face 35*a* so as to be located on the upstream side of the sheet conveying direction toward the upward direction, so that the sheet is delivered from the lower regulating member 35 to the belt 33*c* preferably.

Then, when the uppermost sheet of the sheet bundle reaches the sheet feeding position and the sheet bundle is stopped moving up, the trailing end of the upper sheet of the sheet bundle is regulated by the contact face 34*b* of the upper regulating member 34 that does not elastically deform. As a result, the position of the trailing end of the sheet is reliably regulated by the contact face 34*b*, and the floating uppermost sheet P is prevented from receding. Consequently, as described above, the leading end of the subsequent sheet P and the uppermost sheet P are attracted to the attraction belt 21, which restrains the occurrence of multifeeding.

Similarly, the trailing end of the lower part of the sheet bundle is regulated by the contact face 35*b* of the lower regulating member 35 that does not elastically deform. As described above, the trailing end side of the lower part of the sheet bundle Pf is inclined in the downward direction, following the slope of the movable table 42. Therefore, even it is likely that the lower part of the sheet bundle is lowered by the weight of the sheets, such lowering is firmly regulated by the contact face 35*b* of the lower regulating member 35.

As described above, by firmly regulating the position of the trailing end of the sheet bundle Pf with the regulating member, i.e., the upper regulating member 34 and the lower regulating member 35, at the upper and lower portions of the end fence 25, the tension of the belt 33*c* that contacts the center portion of the sheet bundle Pf is reduced so as to be easily elastically deformable. As a result, both preferable sheet feeding by regulating the position of the trailing end of the sheet bundle and spreading the belt 33*c* following the fan-shaped spread of the trailing end of the sheet bundle P are achieved.

Furthermore, as the sheet feeding proceeds and the number of remaining sheets of the sheet bundle Pf becomes small, the fan-shaped spread on the trailing end side of the sheet bundle Pf is reduced. Therefore, if the movable table 42 is inclined similar to the initial stage, the trailing end side of the uppermost sheet P of the sheet bundle Pf is lowered following the slope of the movable table 42 as the number of remaining sheets of the sheet bundle Pf becomes small. As a result, when the uppermost sheet P is floated, the uppermost sheet P may recede to cause multifeeding.

However, in the present embodiment, as described above, as the sheet loading table 11 is lifted, the movable projection 45*a* contacts the projection 51, the movable table 42 rotates, and the slope of the movable table 42 gradually becomes gentle. Thus, the slope of the movable table 42 is made gentle in accordance with the reduction of the fan-shaped spread on the trailing end side of the sheet bundle Pf accompanying the reduction of the number of sheets of the sheet bundle Pf. As a result, the trailing end side of the uppermost sheet P of the sheet bundle Pf is restrained from being lowered, and suppress receding of the uppermost sheet P is restrained from receding at the time of floating. Accordingly, the occurrence of multifeeding is restrained.

As described above, in the present embodiment, even if the sheet bundle includes sheets having a large thickness deviation in the sheet conveying direction such as a bag provided with a zipper on one side in the sheet conveying direction, and has the trailing end side spreading largely in the fan shape, preferable feeding is performed.

In the above-described embodiments, the sheet feeding device that feeds a sheet has a configuration in which the sheets of the sheet bundle are separated by air, and the sheets are attracted to the attraction belt and conveyed by negative pressure. However, the present invention is not limited to the above-described configuration. For example, this disclosure is applicable to a configuration in which the sheets of the sheet bundle is separated using static electricity, and electrostatically attracted to the attraction belt for conveyance. This disclosure is also applicable to a configuration in which the sheet bundle is separated and conveyed by a roller, as a sheet feeding device.

Further, although the above-described embodiments describe that this disclosure is applied to the image forming system 1 including the image forming apparatus 100 and the sheet feeding device 200 but this disclosure is not limited thereto. For example, this disclosure may be applied to a sheet feeding device (for example, the sheet feeding device 200) provided in the image forming apparatus 100.

The above-described is an example, and each of the following aspects has a unique effect.

Aspect 1.

In Aspect 1, a sheet feeding device (for example, the sheet feeding device 200) includes a sheet loader (for example, the sheet trays 10), a sheet feeder (for example, the sheet feeding unit 20), an end fence (for example, the end fence 25), and an elastic body (for example, the belt 33*c*). The sheet loader is configured to load a sheet bundle (for example, the sheet bundle P) including a sheet (for example, the sheet P). The sheet feeder is configured to feed an uppermost sheet (for example, the uppermost sheet P) of the sheet bundle loaded on the sheet loader. The end fence is disposed movable in a sheet feeding direction of the sheet bundle and is configured to contact a trailing end of the sheet bundle in the sheet feeding direction to regulate a position of the trailing end of the sheet bundle. The elastic body is disposed in a portion other than at least an upper portion of the end fence.

When sheets having a large thickness deviation in the sheet conveying direction are put into a sheet bundle, the thick side spreads in a fan shape. In this manner, when the sheets are set in the sheet loader with the fan-shaped spread as the trailing end side of the sheet conveying direction, the trailing end of the upper part of the sheet bundle is located in the downstream side of the sheet conveying direction from the trailing ends in other positions. Therefore, even if the user moves and contacts the end fence on the trailing end in the sheet conveying direction of the sheet bundle, a gap is generated between the upper part of the sheet bundle and the end fence. As a result, at the time of feeding, the sheet on the upper part of the sheet bundle may recede, a feeding failure or a feeding delay may occur, and preferable feeding may not be performed.

Therefore, in Aspect 1, an elastic body is provided in a predetermined portion excluding at least the upper portion of the end fence. Thus, when the end fence is moved, and the elastic body contacts on the trailing end of the sheet bundle set in the sheet loader and having the trailing end side in the sheet conveying direction of the sheets spreading in a fan shape, the elastic body elastically deforms following the fan-shaped spread, and the end fence is further moved toward the sheet. As a result, the upper portion of the end fence is contacted on the sheet on the upper side of the sheet bundle, in particular, the trailing end of the sheet set in the uppermost portion. Therefore, the trailing end position of the sheet on the upper side of the sheet bundle is preferably regulated by the end fence, and at the time of feeding, receding of the sheet on the upstream side of the sheet bundle is restrained. As a result, the occurrence of a feeding failure and a feeding delay is restrained, and therefore preferable feeding is performed.

Aspect 2.

In Aspect 1, the portion of the end fence is a central portion in a vertical direction of the end fence.

According to this configuration, by setting the predetermined portion as the center portion in the vertical direction of the end fence, the sheet bundle is loaded more stably.

Aspect 3.

In Aspect 2, the sheet loader includes an elevation body configured to elevate and lower the sheet bundle on the sheet loader, and the elastic body has a facing part 33*d* (FIG. 8) that faces at least the sheet is movable in a vertical direction of the elastic body.

According to this configuration, as described in the above embodiments, the elastic body (for example, the belt 33*c*) is moved in the vertical direction together with the sheet bundle, and the sheet bundle is lifted and lowered more smoothly than in a case in which the trailing end in the sheet conveying direction of the sheet bundle is lifted and lowered while sliding on the elastic body.

Aspect 4.

In Aspect 3, a surface of the elastic body is uneven.

According to this configuration, the frictional force between the elastic body (for example, the belt 33*c*) and the trailing end of the sheet bundle is increased, and therefore the elastic body is reliably moved up and down along with lifting and lowering of the sheet.

Aspect 5.

In Aspect 3 or Aspect 4, the elastic body is a belt supported on the end fence and has a surface that is movable endlessly.

According to this configuration, the facing part of the elastic body facing at least the sheet is vertically moved with a simple configuration.

Aspect 6.

In Aspect 5, the sheet feeding device further includes a belt tension adjuster (for example, the upper regulating member 34, the lower regulating member 35) configured to adjust tension of the belt.

According to this configuration, as described in the above embodiments, the tension is adjusted to the optimum according to the hardness of the sheet, and failures such as curving of the sheet due to tension is restrained when the belt is contacted on the trailing end of the sheet bundle to elastically deform the belt.

Aspect 7.

In any one of Aspects 1 to 6, the sheet feeding device further includes at least two elastic bodies (for example, the belt 33*c*) including the elastic body. The at least two elastic bodies are disposed at both ends of the end fence in a width direction of the sheet.

According to this configuration, the trailing end of the sheet bundle is regulated by the elastic bodies (for example, the belts 33*c*), and the position of the trailing end of the sheet is regulated stably.

Aspect 8.

In Aspect 7, elastic forces of the at least two elastic bodies are identical to each other.

According to this configuration, as described in the above embodiments, the elastic forces which is applied from the elastic bodies and is applied to one side and the other side in the width direction of the sheet bundle are equalized, and the sheet is refrained from being bent.

Aspect 9.

In any one of Aspects 1 to 8, the elastic body is configured to move in the sheet feeding direction together with the end fence.

According to this configuration, when the end fence 25 is contacted on the trailing end of the sheet bundle, the elastic body is contacted on the trailing end of the sheet bundle.

Aspect 10.

In any one of Aspects 1 to 9, the sheet feeding device further includes an upper regulator (the upper regulating member 34) disposed on an upper portion of the end fence and projecting toward the sheet loaded on the sheet loader, farther than the elastic body. The upper regulator is configured to regulate a position of a trailing end in the sheet feeding direction of the sheet on an upper portion of the sheet bundle.

According to this configuration, as described in the above embodiments, the position of the trailing end of the sheet is regulated more reliably than the position of the trailing end of the sheet in the case of regulating the trailing end of the upper part of the sheet bundle (for example, the sheet bundle Pf) by the elastic body, and receding of the sheet in the upper portion of the sheet bundle is reliably restrained.

Aspect 11.

In Aspect 10, the sheet feeding device further includes a slope (for example, the sloped guide face 34*a*) inclined away from the sheet loaded on the sheet loader, downwardly toward a lower portion of the upper regulator.

According to this configuration, as described in the above embodiments, when the sheet bundle is lifted, the transition of the contact from the elastic body (for example, the belt 33*c*) in the trailing end of the sheet bundle to the upper regulating member is smoothly performed.

Aspect 12,

In any one of Aspects 1 to 11, the sheet feeding device further includes a lower regulator (for example, the lower regulating member 35) disposed on a lower portion of the end fence and projecting toward the sheet loaded on the sheet loader, farther than the elastic body. The lower regulator is configured to regulate a position of a trailing end in the sheet feeding direction of the sheet on a lower portion of the sheet bundle.

According to this configuration, as described in the above embodiments, the position of the trailing end of the lower part of the sheet bundle is more reliably regulated than the position of the trailing end of the lower part of the sheet bundle in a case in which the position of the trailing end of the lower part of the sheet bundle is regulated by the elastic body (for example, the belt 33*c*).

Aspect 13.

In Aspect 12, the sheet feeding device further includes a slope (for example, the sloped guide face 35*a*) inclined away from the sheet loaded on the sheet loader, upwardly toward an upper portion of the lower regulator.

According to this configuration, as described in the above embodiments, when the sheet bundle is lifted, the transition of the contact from the lower regulating member 35 in the trailing end of the sheet bundle to the elastic body (for example, the belt 33*c*) is smoothly performed.

Aspect 14.

In any one of Aspects 1 to 13, the sheet loader (for example, the sheet trays 10) includes an elevation body (for example, the sheet loading table 11) and a loading unit (for example, the loading unit 40). The elevation body is configured to elevate and lower the sheet bundle on the sheet loader. The loading unit is disposed on the elevation body to load the sheet bundle, the loading unit of the sheet loader including a fixed table (for example, the fixed table 41) and a movable table (for example, the movable table 42) movably disposed upstream from the fixed table in the sheet feeding direction. The movable table is configured to rotate along with upward movement of the elevation body.

According to this configuration, as described in the above embodiments, the number of sheets having a deviation in the sheet conveying direction in the sheet bundle is large and the fan-shaped spread of the trailing end side of the sheet bundle is large, the movable table is inclined to release the spread, so that the fan-shaped spread of the upper part of the sheet bundle is restrained. Thus, degradation of the conveyance capability of a sheet is restrained.

Then, when the elevation body is lifted as the number of sheets in the sheet bundle decreases, the movable table rotates to reduce the inclination of the movable table. Thus, the inclination of the movable table becomes gentle in accordance with the reduction of the fan-shaped spread of the trailing end in the sheet conveying direction of the sheet bundle with the decrease of the number of sheets in the sheet bundle, and lowering of the trailing end side of the uppermost sheet of the sheet bundle is restrained. Therefore, the uppermost sheet of the sheet bundle is prevented from receding from a specified position, and the preferable conveyance capability is maintained.

Aspect 15.

In Aspect 14, the movable table is configured to rotate to elevate an upstream end in the sheet feeding direction of the movable table along with vertical movement of the elevation body.

According to this configuration, as described in the above embodiments, the inclination of the movable table is reduced in accordance with the reduction of the fan-shaped spread of the trailing end in the sheet conveying direction of the sheet bundle with the decrease of the number of sheets of the sheet bundle, and lowering of the trailing end side of the uppermost sheet of the sheet bundle is restrained.

Aspect 16.

In Aspect 14 or Aspect 15, the loading unit is an extension unit attached to the elevation body in a case in which raising and lowering member in feeding of the sheet having a thickness deviation in the sheet conveying direction.

According to this configuration, when a sheet having no thickness deviation in the sheet conveying direction is fed, the loading unit (for example, the loading unit 40) is removed from the elevation body (for example, the sheet loading table 11) so that the sheet having no thickness deviation in the sheet conveying direction is preferably fed. When a sheet having a thickness deviation in the sheet conveying direction is fed, the loading unit is attached to the elevation body so that the sheet having a thickness deviation in the sheet conveying direction is preferably fed.

Aspect 17,

In any one of Aspects 14 to 16, the loading unit includes a link unit (for example, the link mechanism 48) configured to rotate the movable table.

According to this configuration, the force for rotating the movable table is transmitted by the link unit to the movable table, and the movable table is rotated, Aspect 18, In Aspect 17, the link unit includes a plurality of links (the first rotation member 45, the second rotation member 46). A rotation range of the plurality of links is at an angle of less than 90 degrees.

According to this configuration, as described in the above embodiments, the loading unit (for example, the loading unit 40) is reduced in size.

Aspect 19.

In Aspect 20, an image forming apparatus (for example, the image forming apparatus 100) includes an image forming device (for example, the image forming device 101) configured to form an image on a sheet (for example, the sheet P) and the sheet feeding device according to any one of Aspects 1 to 18, configured to feed the sheet toward the image forming apparatus.

According to this configuration, even when the sheet bundle having a thickness deviation in the sheet conveying direction is set, preferable feeding is performed.

Aspect 20.

In Aspect 20, an image forming system (for example, the sheet forming system 1) includes an image forming apparatus (for example, the image forming apparatus 100) including an image forming device (for example, the image forming device 101) configured to form an image at least on a sheet (for example, the sheet P), and the sheet feeding device (for example, the sheet feeding device 200) according to any one of Aspects 1 to 18, configured to feed the sheet toward the image forming apparatus.

According to this, even when the sheet bundle having a thickness deviation in the sheet conveying direction is set, preferable feeding is performed.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet feeding device comprising:

a sheet loader configured to load a sheet bundle including sheets;

a sheet feeder configured to feed an uppermost sheet of the sheet bundle loaded on the sheet loader; and an end fence movable in a sheet feeding direction of the uppermost sheet, the end fence being configured to contact a trailing end of the sheet bundle in the sheet feeding direction to regulate a position of the trailing end of the sheet bundle, and the end fence including an elastic body configured to contact the trailing end of the sheet bundle at a portion other than at least an upper portion of the end fence; and an upper regulator disposed on an upper portion of the end fence and projecting beyond the elastic body toward the sheet loaded on the sheet loader, farther than the elastic body, the upper regulator being configured to regulate the position of the trailing end of the sheet bundle at an upper portion of the sheet bundle.

2. The sheet feeding device according to claim 1, wherein the portion other than at least the upper portion of the end fence is a central portion in a vertical direction of the end fence.

3. The sheet feeding device according to claim 1, wherein the sheet loader includes an elevation body configured to elevate and lower the sheet bundle on the sheet loader, and wherein the elastic body has a facing part that faces at least the sheet bundle, movable in a vertical direction of the elastic body.

4. The sheet feeding device according to claim 3, wherein a surface of the elastic body is uneven.

5. The sheet feeding device according to claim 3, wherein the elastic body is a belt supported on the end fence and has a surface that is movable endlessly.

6. The sheet feeding device according to claim 5, further comprising:

a belt tension adjuster configured to adjust tension of the belt.

7. The sheet feeding device according to claim 1, further comprising:

at least two elastic bodies including the elastic body, wherein the at least two elastic bodies are disposed at both ends of the end fence in a width direction of the sheet.

8. The sheet feeding device according to claim 7, wherein elastic forces of the at least two elastic bodies are identical to each other.

9. The sheet feeding device according to claim 1, wherein the elastic body is configured to move in the sheet feeding direction together with the end fence.

10. The sheet feeding device according to claim 1, further comprising:

a slope inclined away from the sheet bundle loaded on the sheet loader, downwardly toward a lower portion of the upper regulator.

11. The sheet feeding device according to claim 1, further comprising:

a lower regulator disposed on a lower portion of the end fence and projecting beyond the elastic body toward the sheet bundle loaded on the sheet loader, farther than the elastic body, the lower regulator configured to regulate the position of the trailing end of the sheet bundle at a lower portion of the sheet bundle.

12. The sheet feeding device according to claim 11, further comprising:

a slope inclined away from the sheet loaded on the sheet loader, upwardly toward an upper portion of the lower regulator.

13. An image forming apparatus comprising:

an image forming device configured to form an image on a sheet; and the sheet feeding device according to claim 1, configured to feed the sheet toward the image forming device.

14. An image forming system comprising:

an image forming apparatus including an image forming device configured to form an image on a sheet; and the sheet feeding device according to claim 1, configured to feed the sheet toward the image forming apparatus.

15. A sheet feeding device, comprising:

a sheet loader configured to load a sheet bundle including sheets;

a sheet feeder configured to feed an uppermost sheet of the sheet bundle loaded on the sheet loader; and an end fence movable in a sheet feeding direction of the uppermost sheet, the end fence being configured to contact a trailing end of the sheet bundle in the sheet feeding direction to regulate a position of the trailing end of the sheet bundle, and the end fence including an elastic body configured to contact the trailing end of the sheet bundle at a portion other than at least an upper portion of the end fence, wherein the sheet loader includes:

an elevation body configured to elevate and lower the sheet bundle on the sheet loader; and a loading unit disposed on the elevation body to load the sheet bundle, the loading unit of the sheet loader including a fixed table and a movable table movably disposed upstream from the fixed table in the sheet feeding direction, and wherein the movable table is configured to rotate along with upward movement of the elevation body.

16. The sheet feeding device according to claim 15, wherein the movable table is configured to rotate to elevate an upstream end in the sheet feeding direction of the movable table along with vertical movement of the elevation body.

17. The sheet feeding device according to claim 15, wherein the loading unit is an extension unit attached to the elevation body in a case in which the sheet feeding device feeds a sheet having a thickness deviation in the sheet conveying direction.

18. The sheet feeding device according to claim 15, wherein the loading unit includes a link unit configured to rotate the movable table.

19. The sheet feeding device according to claim 18, wherein the link unit includes a plurality of links, and wherein a rotation range of the plurality of links is at an angle of less than 90 degrees.

20. An image forming system comprising:

an image forming apparatus including an image forming device configured to form an image on a sheet; and the sheet feeding device according to claim 15, configured to feed the sheet toward the image forming apparatus.

* * * * *